US011591140B2

(12) United States Patent
Eickhoff et al.

(10) Patent No.: US 11,591,140 B2
(45) Date of Patent: Feb. 28, 2023

(54) DRINK CUP LID

(71) Applicant: Berry Global, Inc., Evansville, IN (US)

(72) Inventors: Jonathan Eickhoff, Evansville, IN (US); Braxton J. Bragg, Evansville, IN (US); Jeffrey A. Mann, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 83 days.

(21) Appl. No.: 16/993,493

(22) Filed: Aug. 14, 2020

(65) Prior Publication Data

US 2021/0047083 A1 Feb. 18, 2021

Related U.S. Application Data

(60) Provisional application No. 62/887,252, filed on Aug. 15, 2019.

(51) Int. Cl.

| | |
|---|---|
| ***B65D 43/02*** | (2006.01) |
| ***A47G 19/22*** | (2006.01) |
| ***B65D 47/08*** | (2006.01) |

(52) U.S. Cl.

CPC ..... *B65D 43/0212* (2013.01); *A47G 19/2272* (2013.01); *B65D 47/0833* (2013.01); *B65D 2543/00046* (2013.01); *B65D 2543/00092* (2013.01); *B65D 2543/00712* (2013.01)

(58) Field of Classification Search

CPC ..... A47G 19/2272; B65D 47/0833; B65D 43/0212; B65D 43/02; B65D 2543/00796; B65D 2543/00731; B65D 2543/00712; B65D 2543/00537; B65D 2543/00296; B65D 2543/00092; B65D 2543/00046

USPC ..... 220/711

See application file for complete search history.

(56) References Cited

U.S. PATENT DOCUMENTS

| | | | |
|---|---|---|---|
| 3,392,468 | A | 7/1968 | Wolf |
| 3,954,923 | A | 5/1976 | Valyi |
| D246,955 | S | 1/1978 | Davis |
| D248,376 | S | 7/1978 | Allen |
| D251,828 | S | 5/1979 | Smith |
| D261,486 | S | 10/1981 | Smith |
| 4,413,964 | A | 11/1983 | Winstead |
| D271,857 | S | 12/1983 | Callahan |
| D272,324 | S | 1/1984 | Mumford |
| D398,997 | S | 9/1998 | Taylor |
| D487,411 | S | 3/2004 | Bamminger |
| D694,109 | S | 11/2013 | Tanner |

(Continued)

FOREIGN PATENT DOCUMENTS

| | | |
|---|---|---|
| EP | 0934893 A1 | 8/1999 |
| EP | 1319493 A1 | 6/2003 |

(Continued)

OTHER PUBLICATIONS

Office Action dated Jul. 1, 2021 for U.S. Appl. No. 15/172,650, BP-409 (pp. 1-6).

(Continued)

*Primary Examiner* — James N Smalley
*Assistant Examiner* — Madison L Poos
(74) *Attorney, Agent, or Firm* — Barnes & Thornburg LLP

(57) ABSTRACT

A liquid container includes a cup having a brim forming an opening into an interior region of the cup. The container also includes a lid configured to mount on the brim of the cup to close the opening.

19 Claims, 29 Drawing Sheets

(56) References Cited

U.S. PATENT DOCUMENTS

| | | | | |
|---|---|---|---|---|
| D751,382 | S | 3/2016 | Torrison | |
| 9,814,334 | B2 * | 11/2017 | Eickhoff | B65D 47/0833 |
| D930,476 | S | 9/2021 | Bontrager | |
| D945,264 | S | 3/2022 | Eickhoff | |
| D955,160 | S | 6/2022 | Liu | |
| 11,433,591 | B2 | 9/2022 | Eickhoff | |
| 2005/0037168 | A1 | 2/2005 | Dalgewicz | |
| 2006/0226148 | A1 * | 10/2006 | Hundley | B65D 47/0847 229/404 |
| 2009/0026219 | A1 | 1/2009 | Bal | |
| 2011/0062173 | A1 | 3/2011 | Trotter | |
| 2011/0089187 | A1 | 4/2011 | Steiger | |
| 2011/0284564 | A1 | 11/2011 | Hsieh | |
| 2011/0297573 | A1 | 12/2011 | Chen | |
| 2012/0261417 | A1 * | 10/2012 | Tabor | B29C 51/268 220/254.1 |
| 2014/0263378 | A1 | 9/2014 | Bolek | |
| 2014/0284344 | A1 * | 9/2014 | French | A47G 19/2272 220/713 |
| 2015/0076151 | A1 * | 3/2015 | Knipe | B65D 47/0847 220/254.1 |
| 2016/0137364 | A1 | 5/2016 | Pirrella | |
| 2020/0029712 | A1 | 1/2020 | O'Nan | |
| 2021/0362912 | A1 * | 11/2021 | Lai | B65D 21/023 |
| 2022/0041341 | A1 | 2/2022 | Eickhoff | |

FOREIGN PATENT DOCUMENTS

| | | | |
|---|---|---|---|
| EP | 1208958 | B1 | 1/2006 |
| FR | 2484903 | A1 | 12/1981 |
| JP | 11040499 | A | 2/1999 |
| JP | 2002241514 | A | 8/2002 |
| JP | 2021041995 | A * | 3/2021 |

OTHER PUBLICATIONS

Chinese Office Action for Chinese Patent App. No. 20180065303.8 dated Jun. 15, 2021, 12 pages.

European First Substantive Examination Report for European App. No. 18780978.5 dated Aug. 24, 2021, 4 pages.

European Search Report for European App. No. 18780978.5 dated Jan. 28, 2021, 8 pages.

Second Chinese Office Action for Chinese Patent App. No. 20180065303.8 dated Jun. 24, 2022, 9 pages.

Thermoform Spill Resistant Flat Lid: Site Visited [Feb. 15, 2022], Available from Internet URL: https://catalog.berryglobal.com/ products/ lid/liddrink/dlt408srcp.

Office Action dated Feb. 22, 2022 for U.S. Appl. No. 29/765,808, (pp. 1-8).

European Search Report for European App. No. 18844658.7 dated Apr. 4, 2021, 11 pages.

Office Action dated Dec. 30, 2020 for U.S. Appl. No. 15/172,650, (pp. 1-24).

Office Action dated Aug. 26, 2022 for U.S. Appl. No. 29/765,808, (pp. 1-5).

Office Action (Non-Final Rejection) dated Oct. 5, 2022 for U.S. Appl. No. 17/550,292 (pp. 1-13).

International (PCT) Search Report and Written Opinion for PCT/US2022/035911 dated Oct. 5, 2022, 8 pages.

DART Hot/Cold Cup Lid: Site Visited (Nov. 30, 2022). Available from URL: :https://www.grainger.com/product/1UCV4?gucic :N:PS:Paid:GGL:CSM-2295:4P7A1P:20501231&gclid=EAIaIQobChMIps6Jzu7W-wIVIYXICh0npwZYEAKYCyABEgKSkfD_BwE& gclsrc=aw.ds.

Dixie Long-Skirt Selector Lid: Site Visited (Nov. 30, 2022). Available from URL: https://caljaninc.eom/catalog/p/DXE- 914LSRD/Dixie-Long-Skirt-Selector-Lid-For-12-16-21-oz/.

Office Action dated Dec. 8, 2022 for U.S. Appl. No. 29/843,255, BP-531 US-DES-CON || (pp. 1-8).

Office Action dated Dec. 8, 2022 for U.S. Appl. No. 29/843,256, BP-538 US-DES-CON || (pp. 1-8).

Supplementary European Search Report for European App. No. 20753051.0 dated Jan. 3, 2023, BP-535 EP || 13 pages.

European Examination Report for EP 18780978.5 dated Nov. 25, 2022, BP-513 EP || 5 pages.

* cited by examiner

DRINK CUP LID

PRIORITY CLAIM

This application claims priority under 35 U.S.C. § 119(e) to U.S. Provisional Application No. 62/887,252, filed Aug. 15, 2019, which is expressly incorporated by reference herein.

BACKGROUND

The present disclosure relates to drink cups, and particularly to lids for drink cups. More particularly, the present disclosure relates to a lid with an opening for removing liquid from the drink cup and a closure that blocks the opening.

SUMMARY

According to the present disclosure, a liquid container comprises a lid adapted to mate with the brim of a cup. The cup also includes a floor and a side wall extending from the brim toward the floor.

In illustrative embodiments, the lid includes a central closure formed to include the liquid-discharge outlet and a ring-shaped brim mount arranged to surround the central closure. The brim mount of the lid is configured to mate with the brim of the cup to hold the central closure in a stationary position closing a cup mouth opening into an interior liquid reservoir chamber formed in the cup and placing the liquid-discharge outlet in fluid communication with any liquid stored in the interior liquid reservoir chamber of the cup.

In illustrative embodiments, the central closure includes an upstanding drink spout having a top wall that is formed to include the liquid-discharge outlet. An outlet closure is coupled to the drink spout for pivotable movement about a horizontal pivot axis between a closed position blocking access to the liquid-discharge outlet and an opened position spaced apart from the liquid-discharge outlet.

In illustrative embodiments, the lid is made from a thermoformed sheet of polypropylene. The lid is formed to have a low profile and a thickness of the lid is minimized to reduce an overall weight of the lid thereby saving material. The outlet closure includes a reinforcement structure to rigidify the outlet closure to reduce unwanted bending of the outlet closure due to the reduction in material used to form the lid. The reinforcement structure stiffens the outlet closure so that when a consumer pivots the outlet closure from the closed position to the opened position, the outlet closure is aligned with an outlet closure retainer that is used to hold the outlet closure in the opened position so that the consumer can drink from the liquid-discharge outlet.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 9:
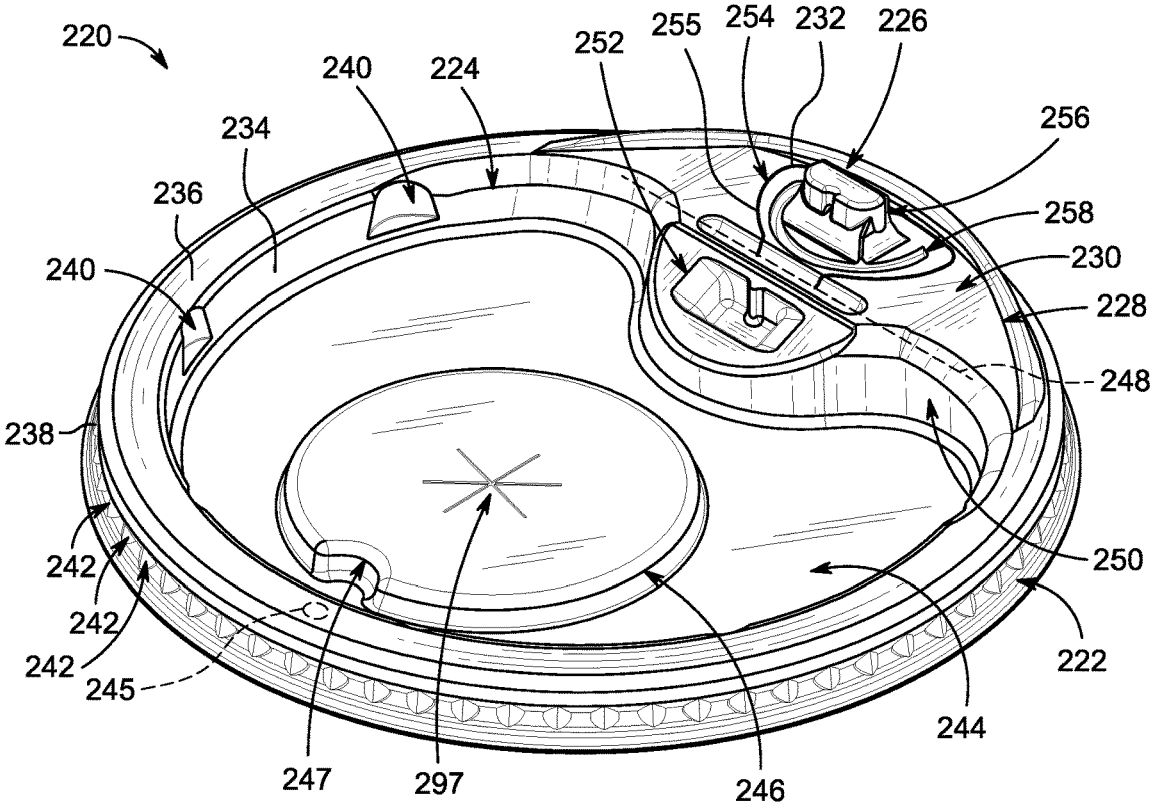
FIG. 9 is a perspective view of a second embodiment of a lid in accordance with the present disclosure including a straw opening.
Figure 10:
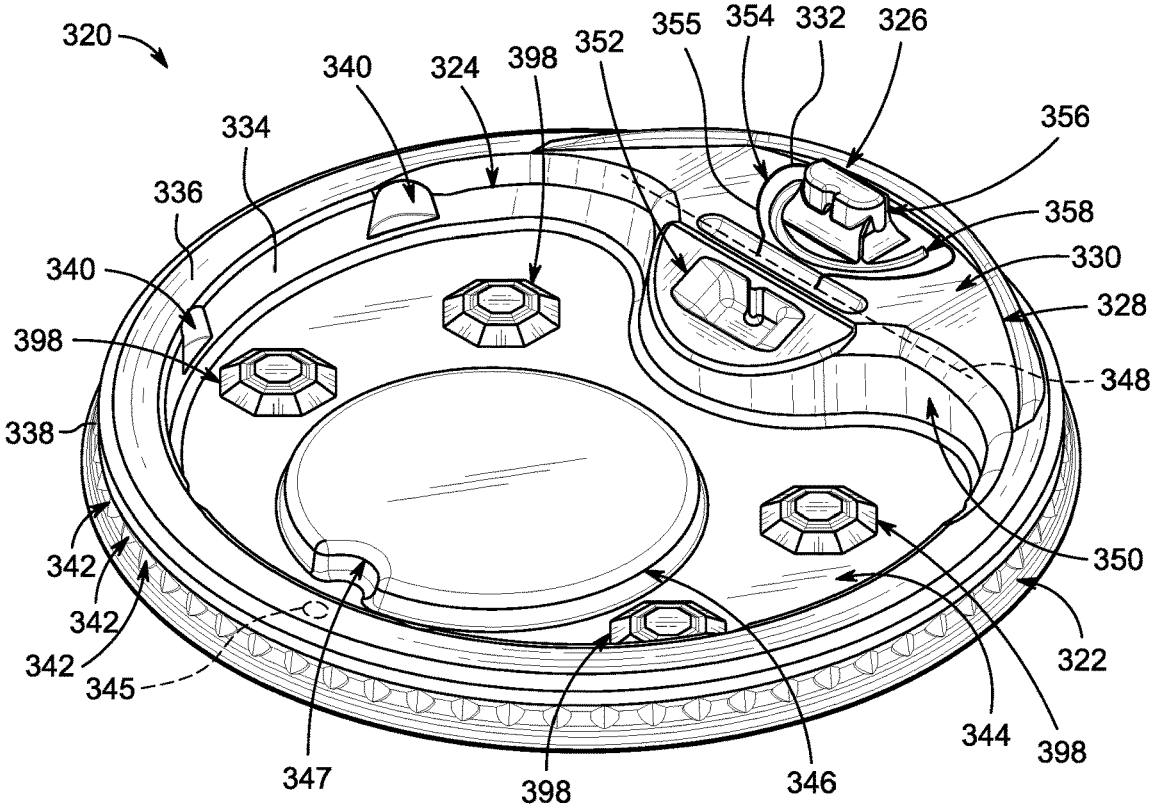
FIG. 10 is a perspective view of a third embodiment of a lid in accordance with the present disclosure including a plurality of flavor buttons.
Figure 11:
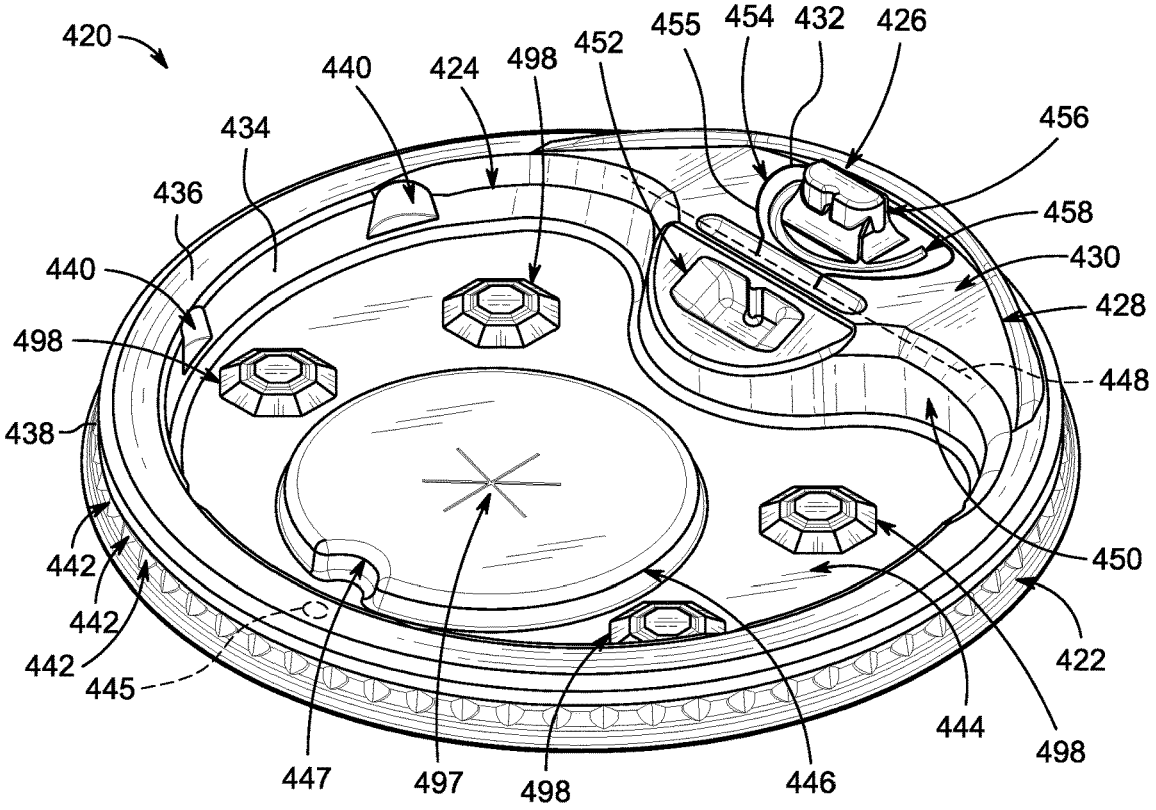
FIG. 11 is a perspective view of a fourth embodiment of a lid in accordance with the present disclosure including a straw opening and a plurality of flavor buttons.
Figure 12:
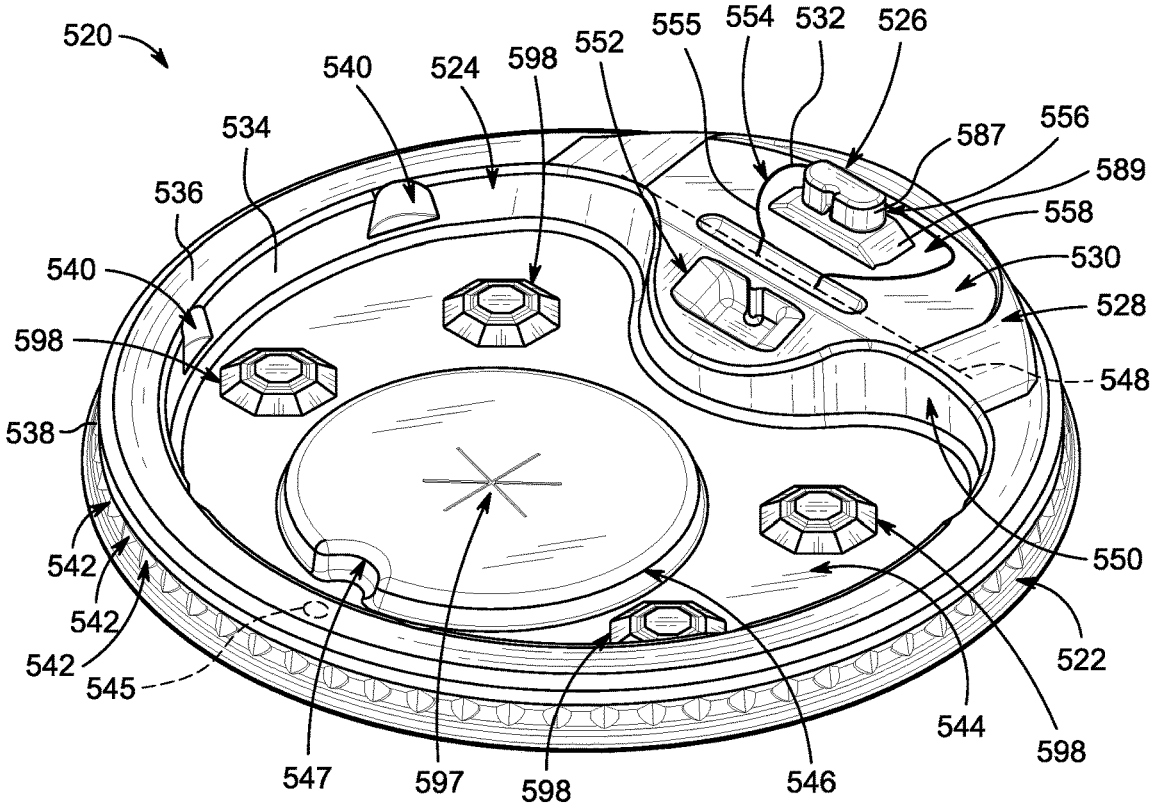
FIG. 12 is a perspective view of a fifth embodiment of a lid in accordance with the present disclosure including an upstanding drink spout with an outlet closure that is different from the outlet closure of the lids shown in FIGS. 1-11.
Figure 13:
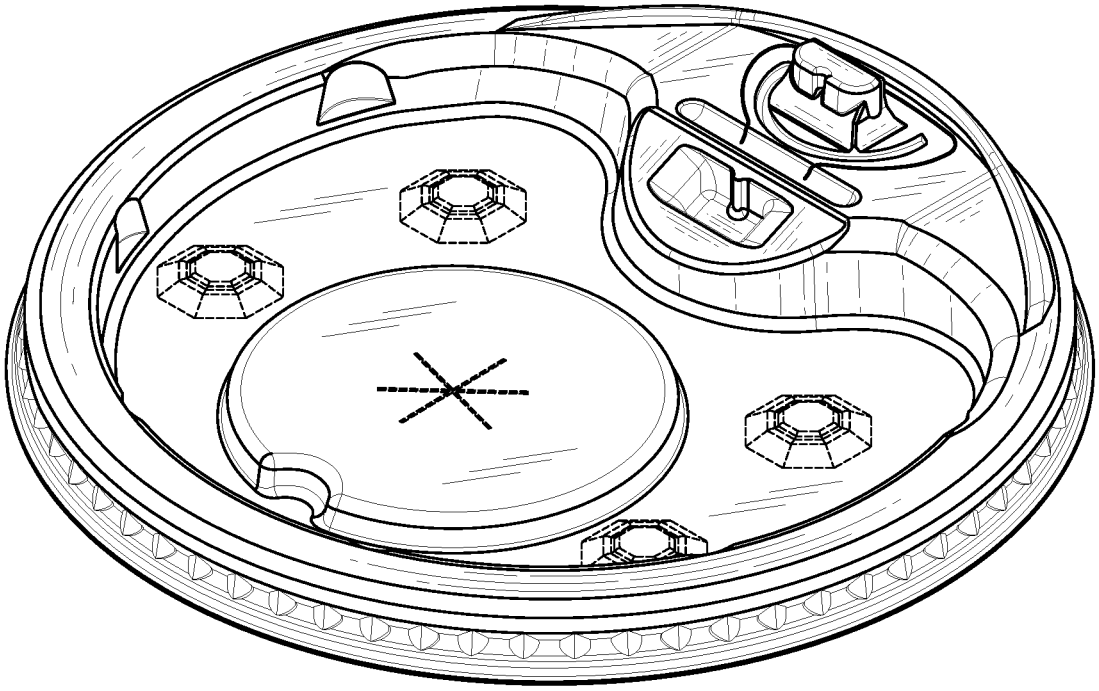
FIG. 13 is a perspective view of a sixth embodiment of a lid in accordance with the present disclosure.
Figure 14:
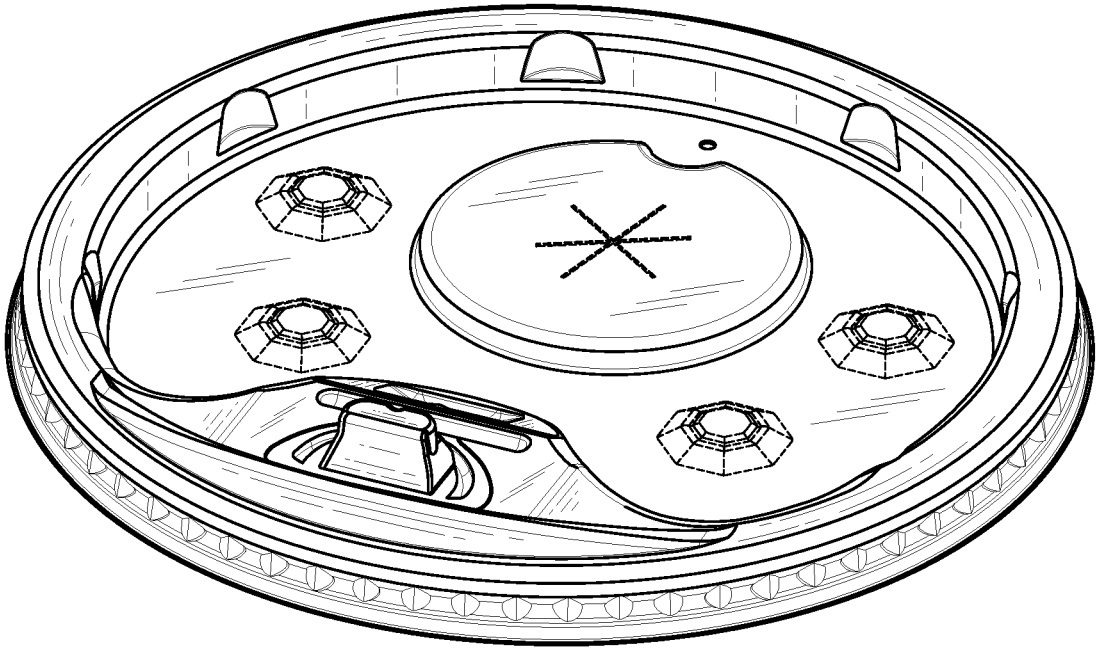
FIG. 14 is a top perspective view of the sixth embodiment of the lid.
Figure 15:
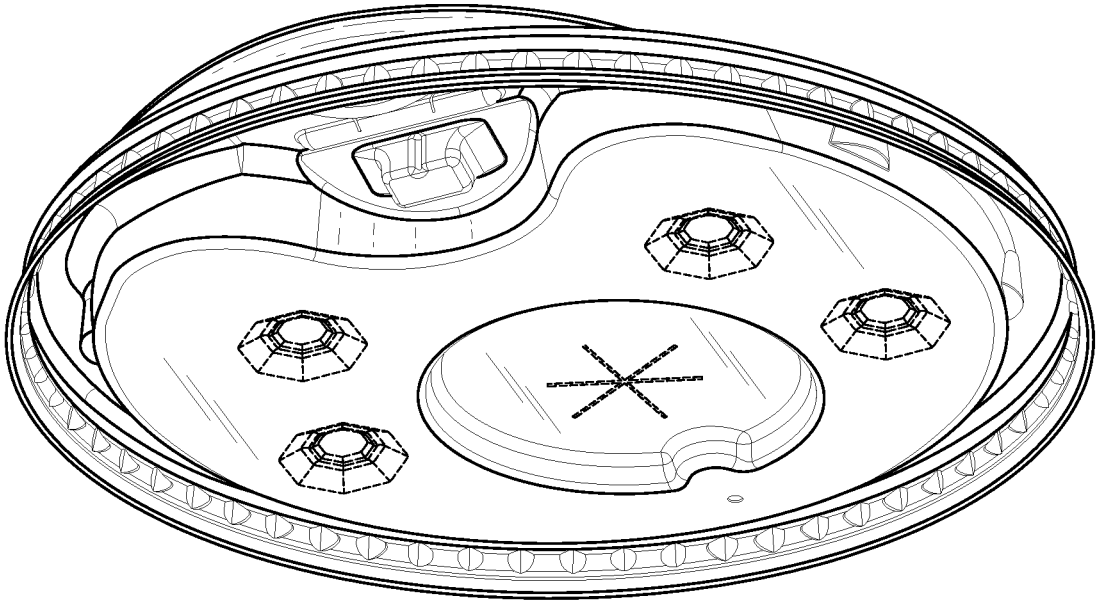
FIG. 15 is a bottom perspective view of the sixth embodiment of the lid
Figure 16:
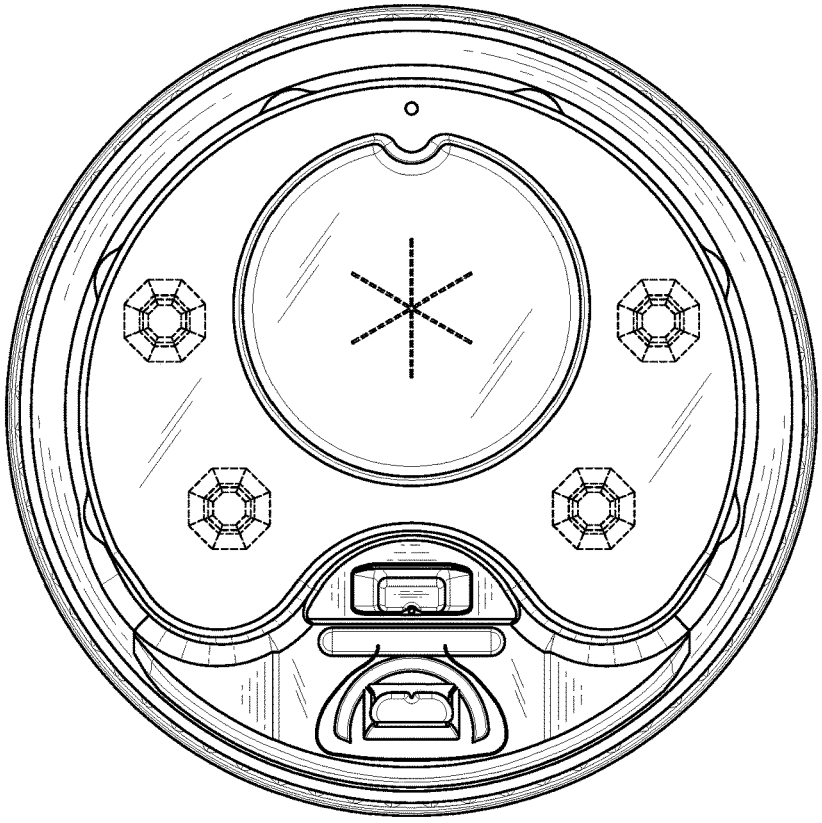
FIG. 16 is a top plan view of a sixth embodiment of the lid.
Figure 17:
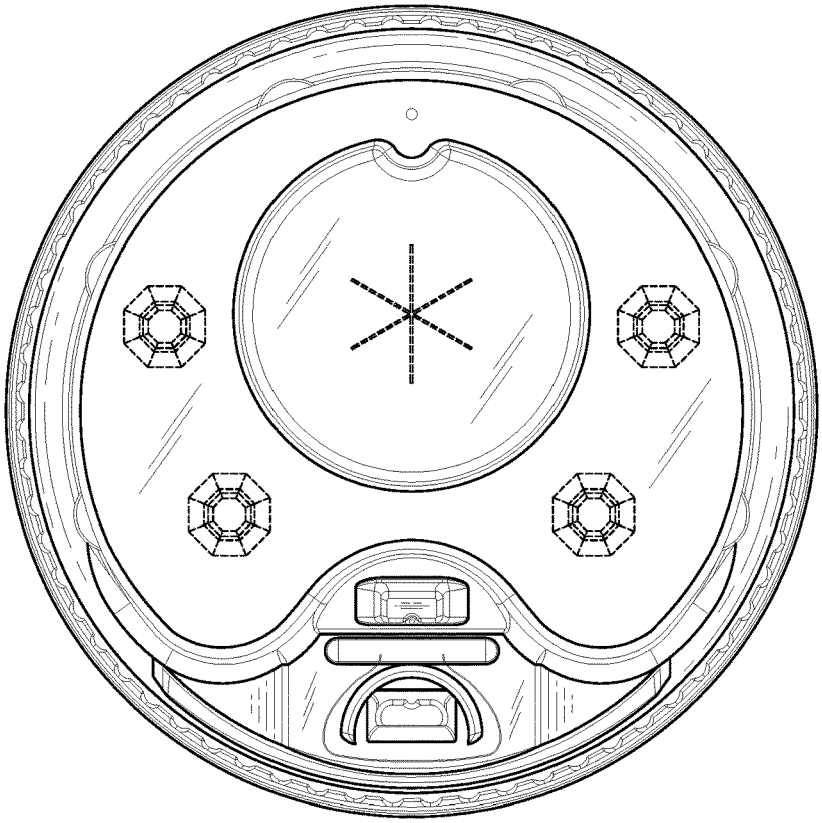
FIG. 17 is a bottom plan view of the sixth embodiment of the lid.
Figure 18:
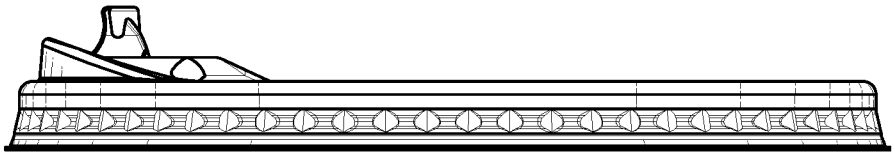
FIG. 18 is a side elevation view of the sixth embodiment of the lid.
Figure 19:
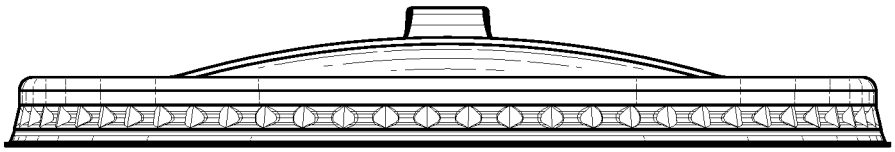
FIG. 19 is a rear elevation view of the sixth embodiment of the lid.
Figure 20:
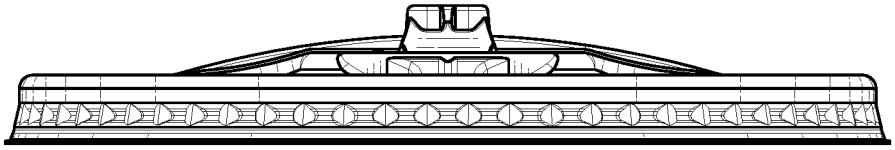
FIG. 20 is a front elevation view of the sixth embodiment of the lid.
Figure 21:
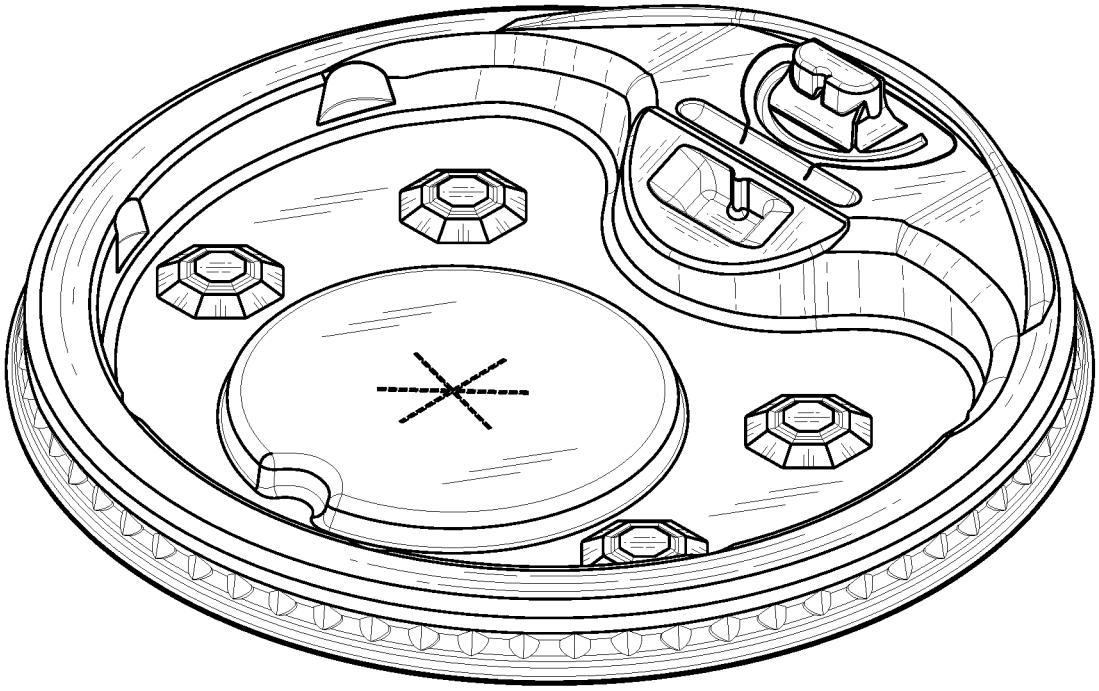
FIG. 21 is a perspective view of a seventh embodiment of a lid in accordance with the present disclosure.
Figure 22:
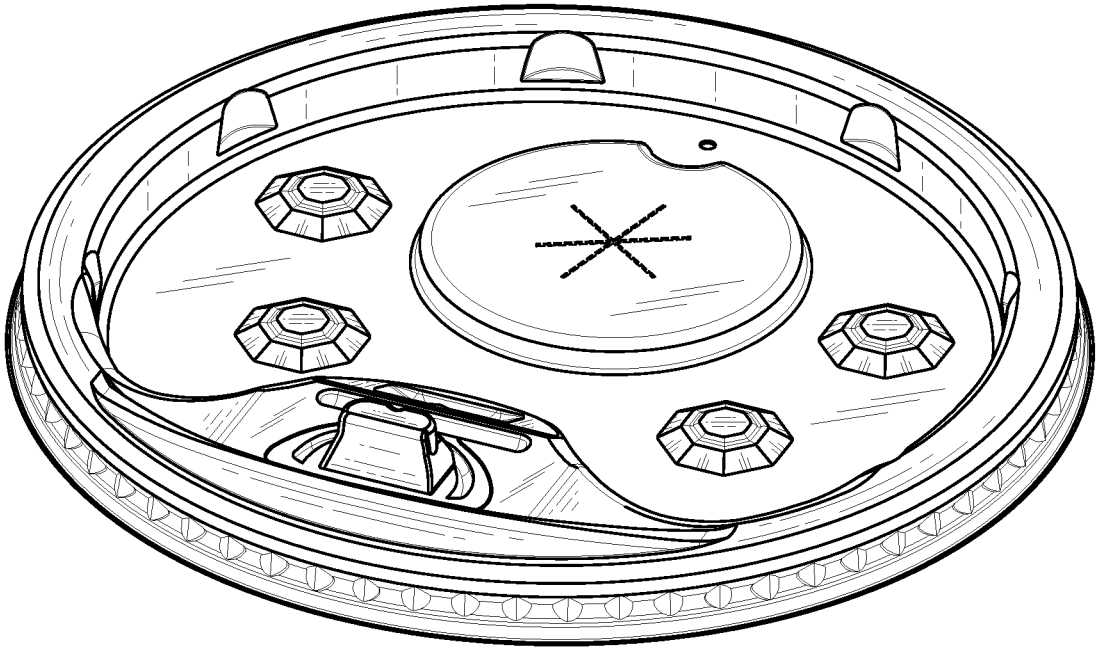
FIG. 22 is a top perspective view of the seventh embodiment of the lid.
Figure 23:
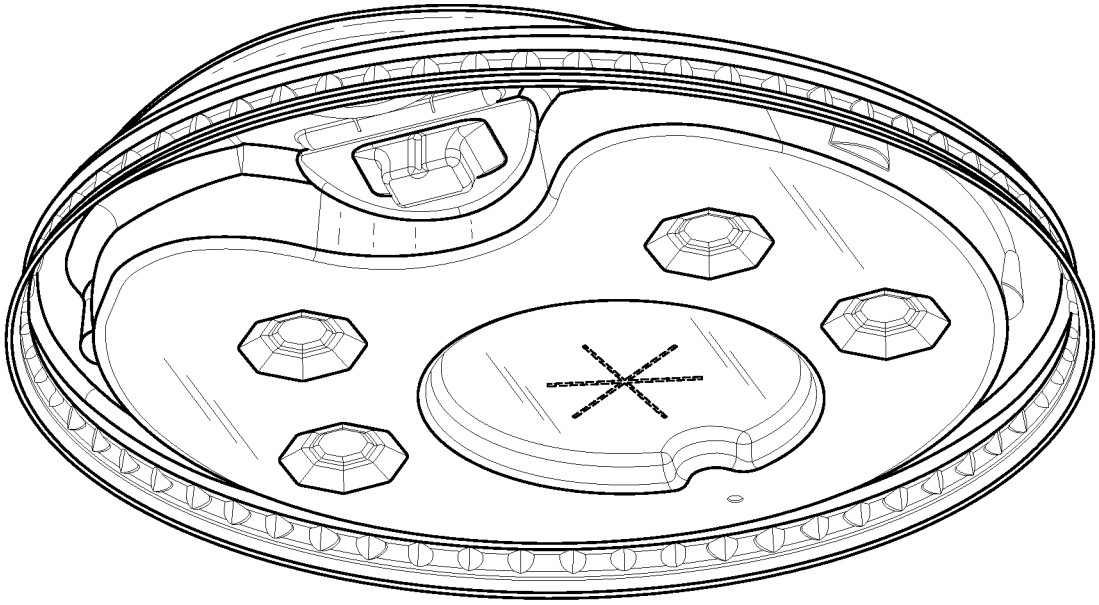
FIG. 23 is a bottom perspective view of the seventh embodiment of the lid
Figure 24:
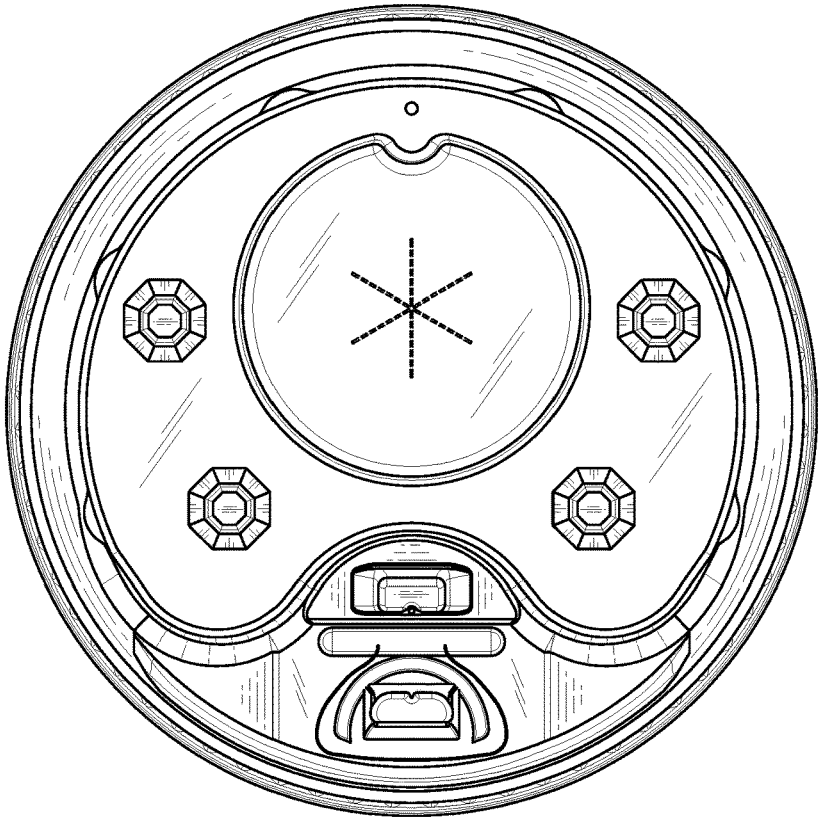
FIG. 24 is a top plan view of the seventh embodiment of the lid.
Figure 25:
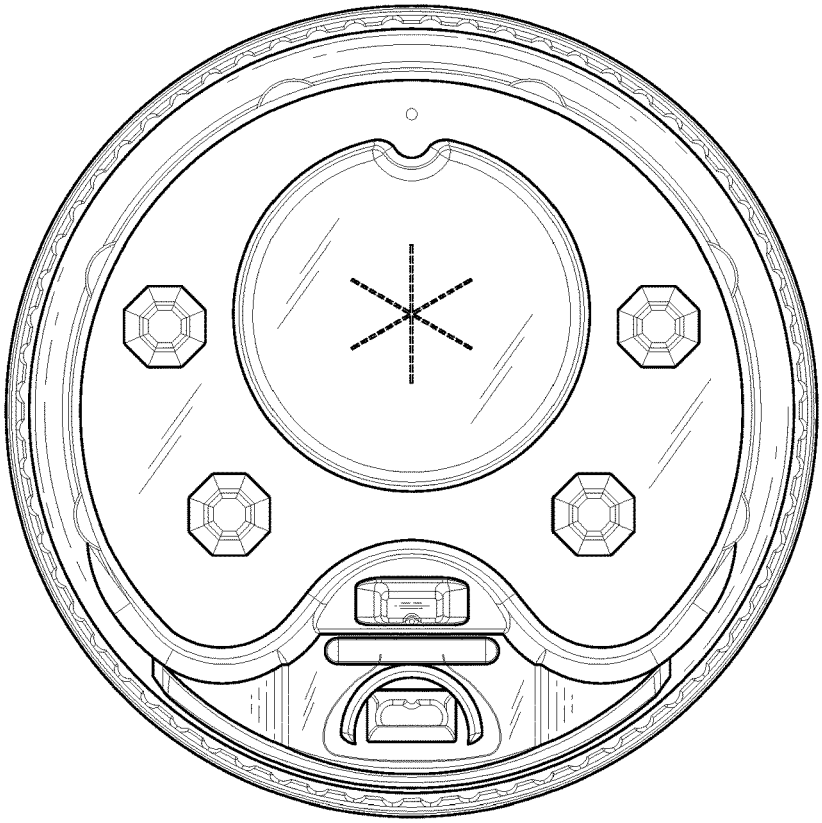
FIG. 25 is a bottom plan view of the seventh embodiment of the lid.
Figure 26:
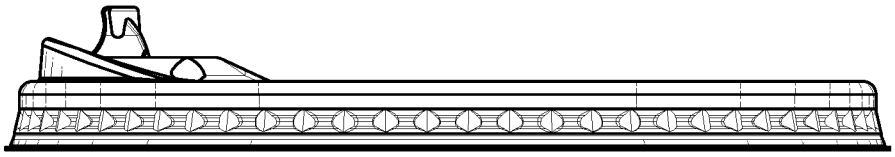
FIG. 26 is a side elevation view of the seventh embodiment of the lid.
Figure 27:
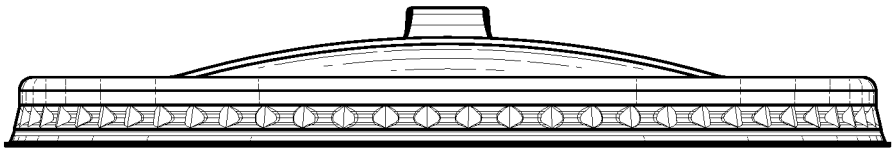
FIG. 27 is a rear elevation view of the seventh embodiment of the lid.
Figure 28:
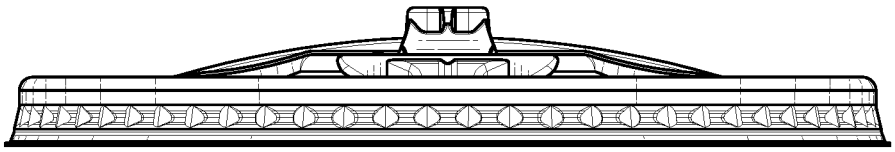
FIG. 28 is a front elevation view of the seventh embodiment of the lid.
Figure 29:
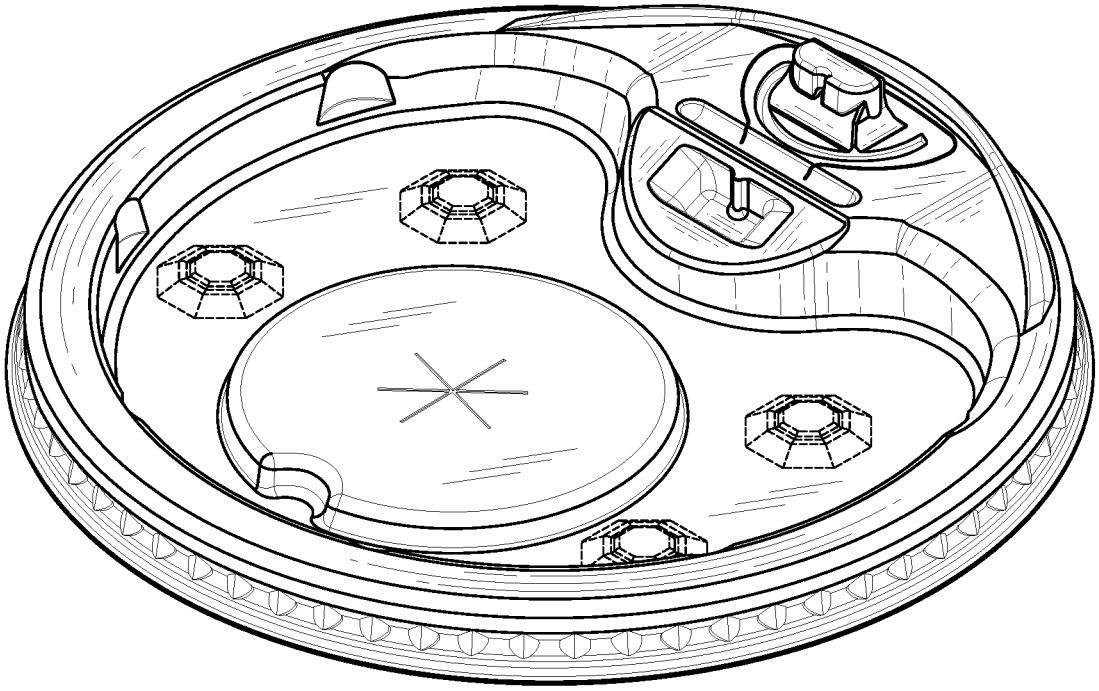
FIG. 29 is a perspective view of an eighth embodiment of a lid in accordance with the present disclosure.
Figure 30:
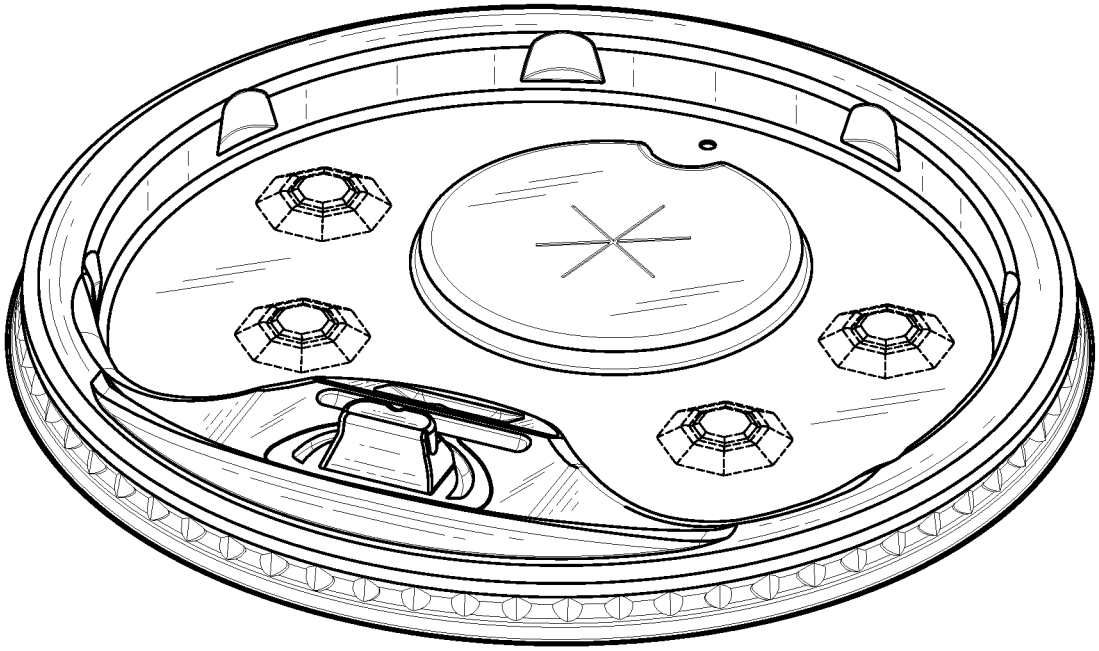
FIG. 30 is a top perspective view of the eighth embodiment of the lid.
Figure 31:
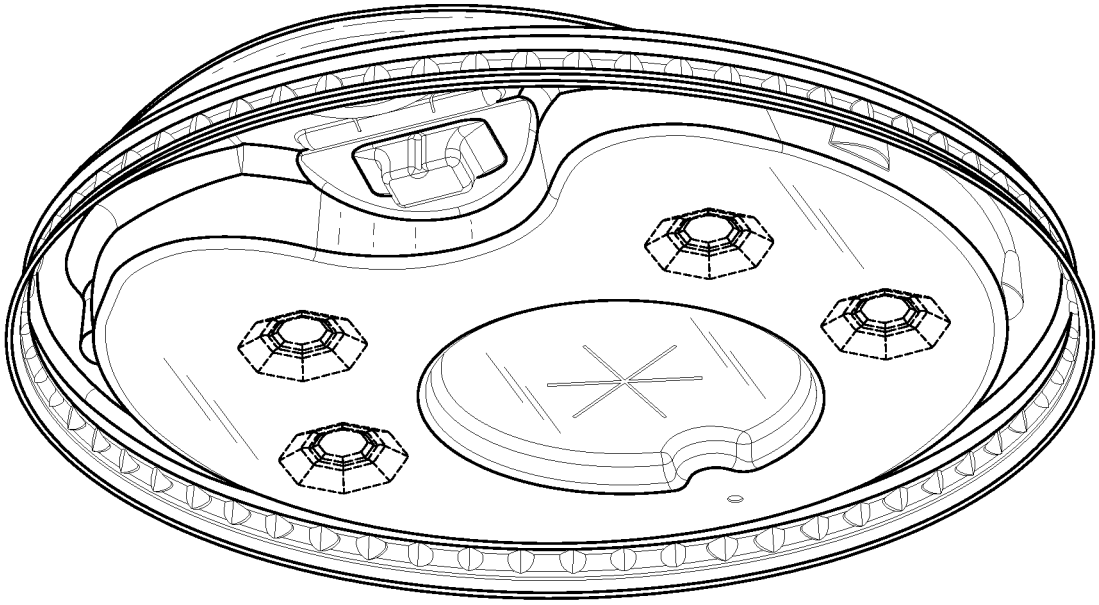
FIG. 31 is a bottom perspective view of the eighth embodiment of the lid
Figure 32:
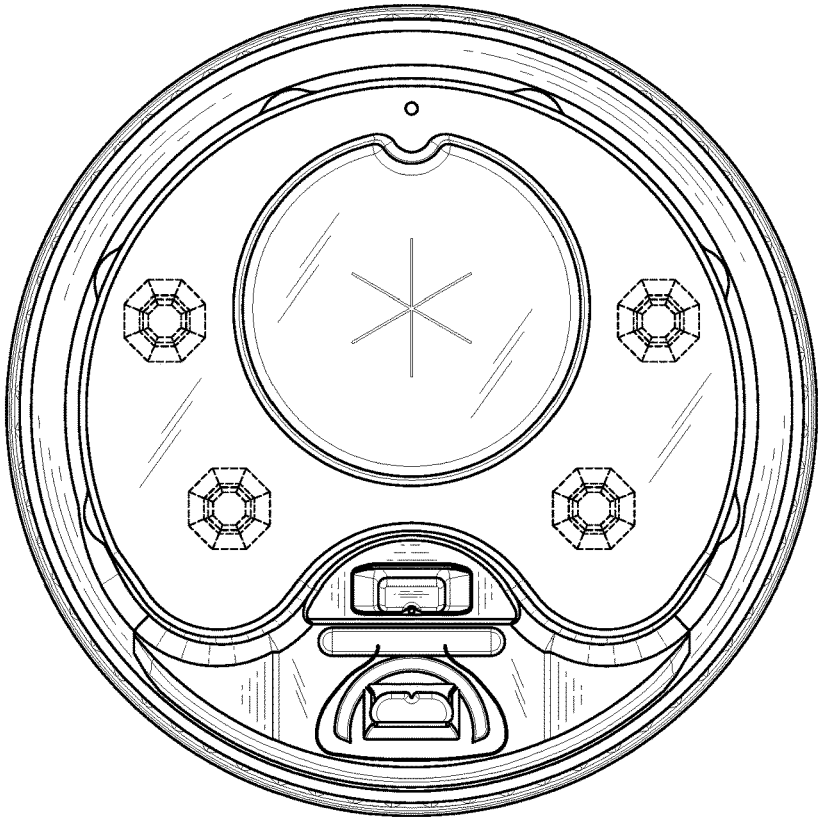
FIG. 32 is a top plan view of the eighth embodiment of the lid.
Figure 33:
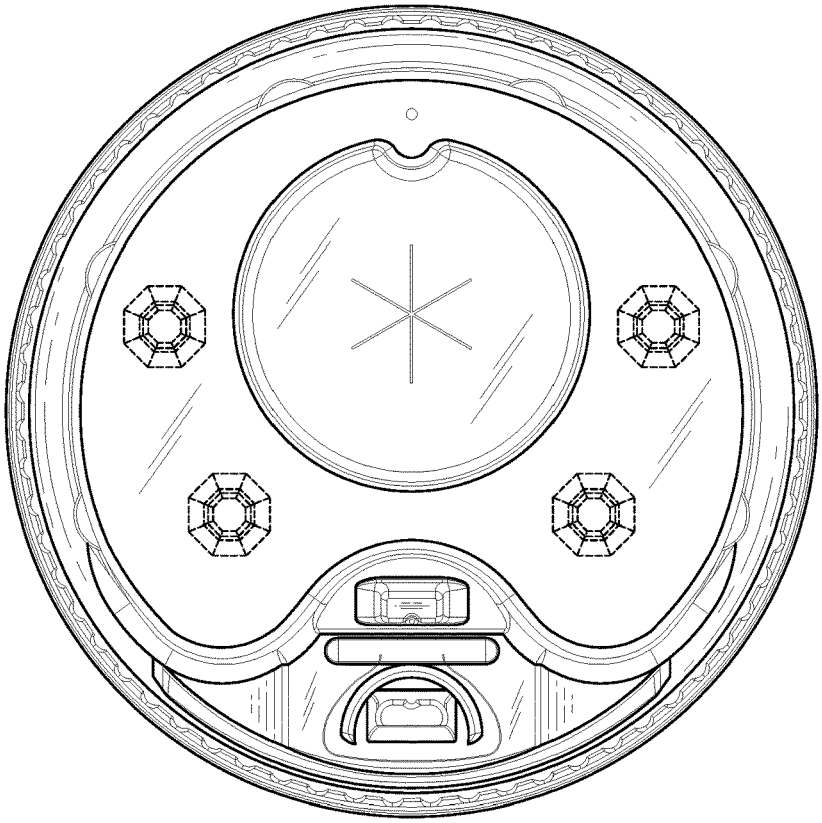
FIG. 33 is a bottom plan view of the eighth embodiment of the lid.
Figure 34:
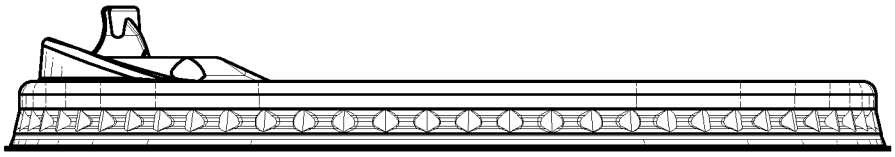
FIG. 34 is a side elevation view of the eighth embodiment of the lid.
Figure 35:
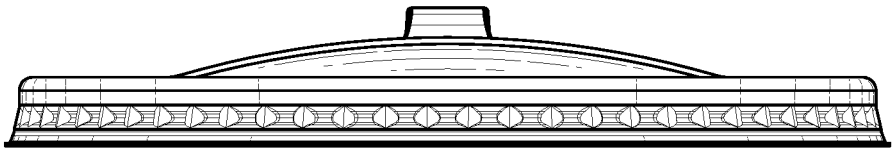
FIG. 35 is a rear elevation view of the eighth embodiment of the lid.
Figure 36:
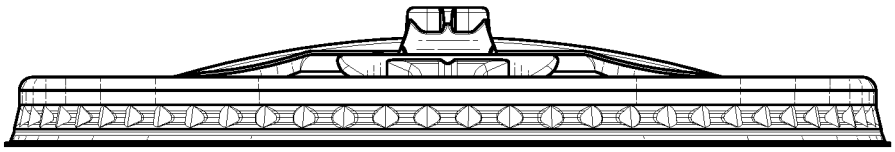
FIG. 36 is a front elevation view of the eighth embodiment of the lid.
Figure 37:
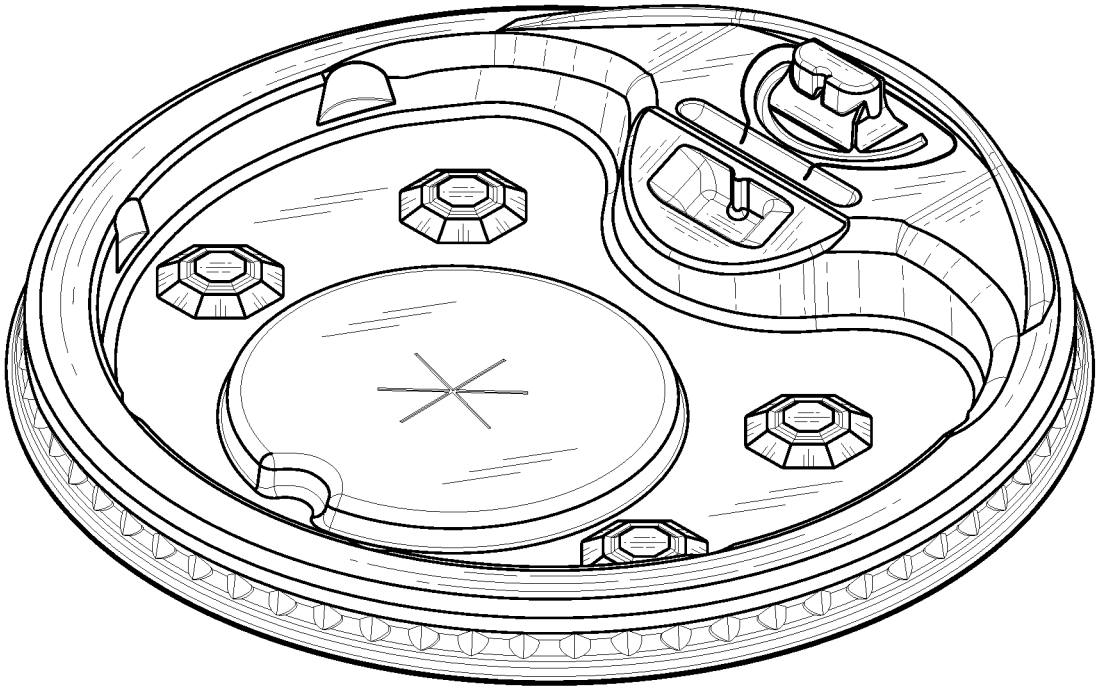
FIG. 37 is a perspective view of a ninth embodiment of a lid in accordance with the present disclosure.
Figure 38:
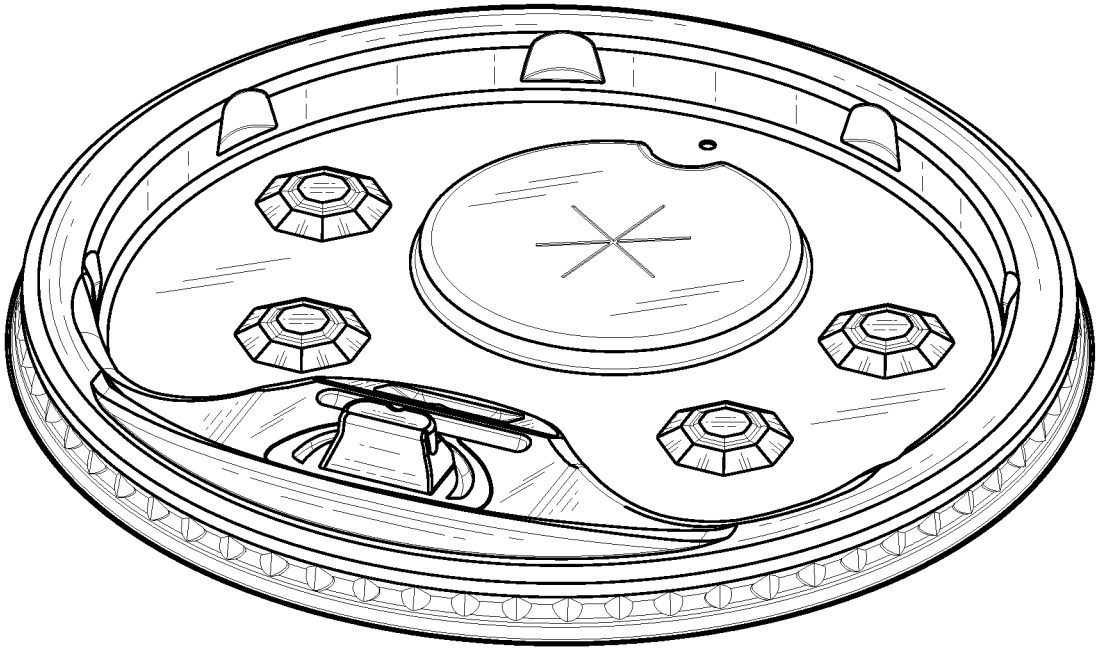
FIG. 38 is a top perspective view of the ninth embodiment of the lid.
Figure 39:
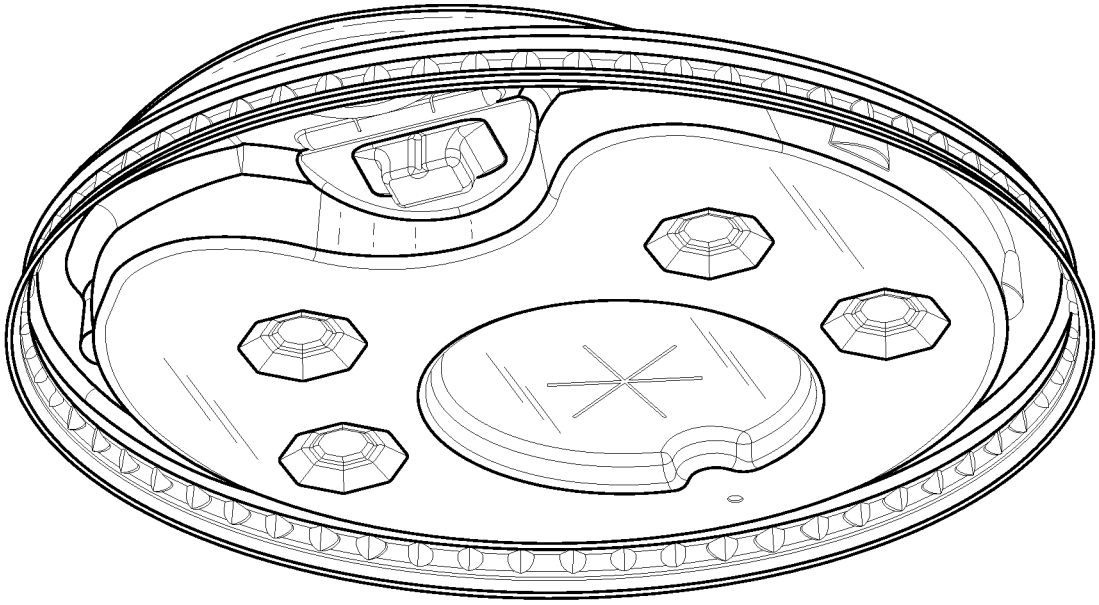
FIG. 39 is a bottom perspective view of the ninth embodiment of the lid
Figure 40:
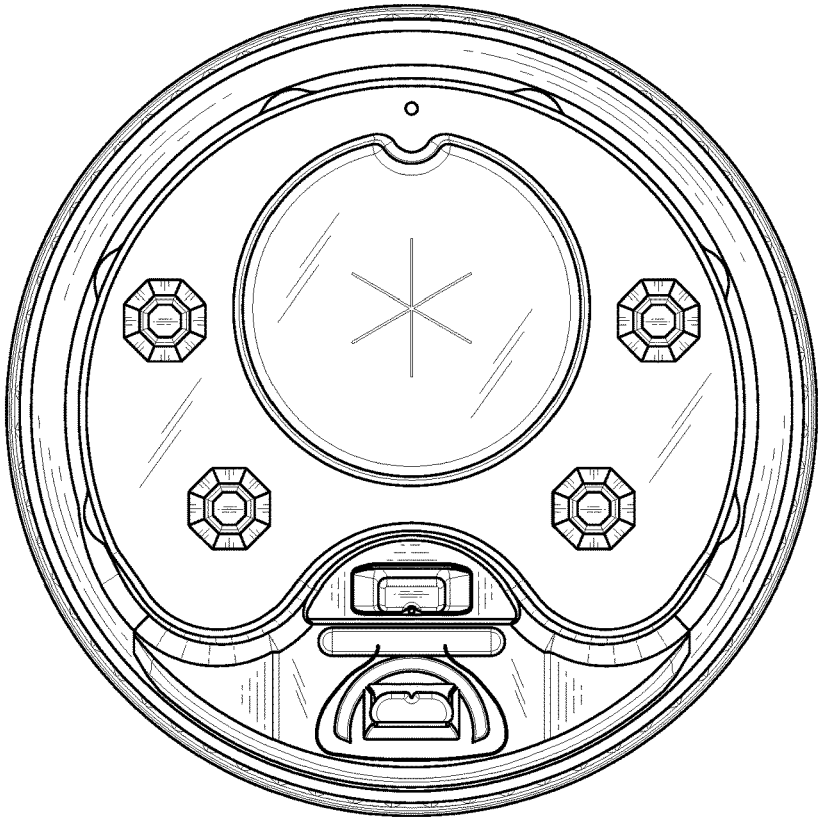
FIG. 40 is a top plan view of the ninth embodiment of the lid.
Figure 41:
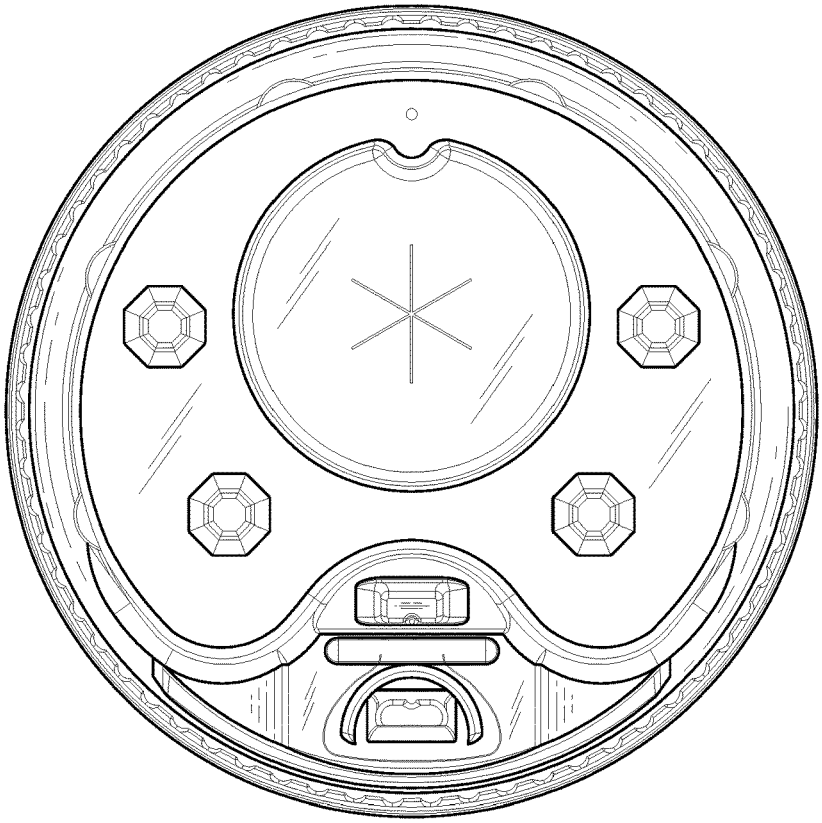
FIG. 41 is a bottom plan view of the ninth embodiment of the lid.
Figure 42:
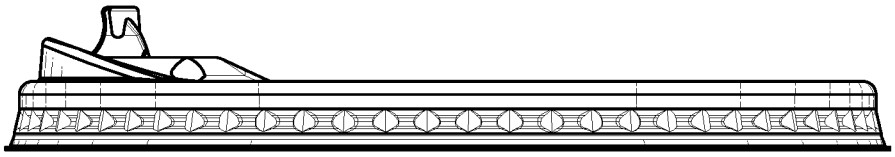
FIG. 42 is a side elevation view of the ninth embodiment of the lid.
Figure 43:
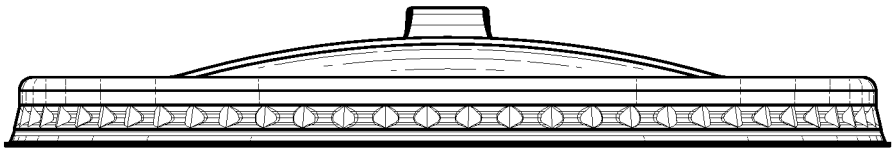
FIG. 43 is a rear elevation view of the ninth embodiment of the lid.
Figure 44:
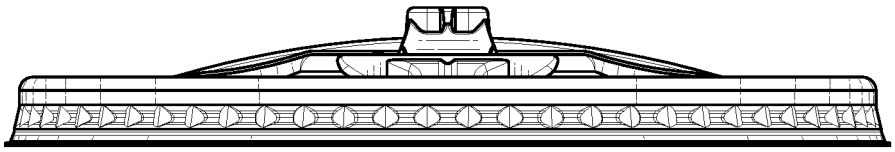
FIG. 44 is a front elevation view of the ninth embodiment of the lid.
Figure 45:
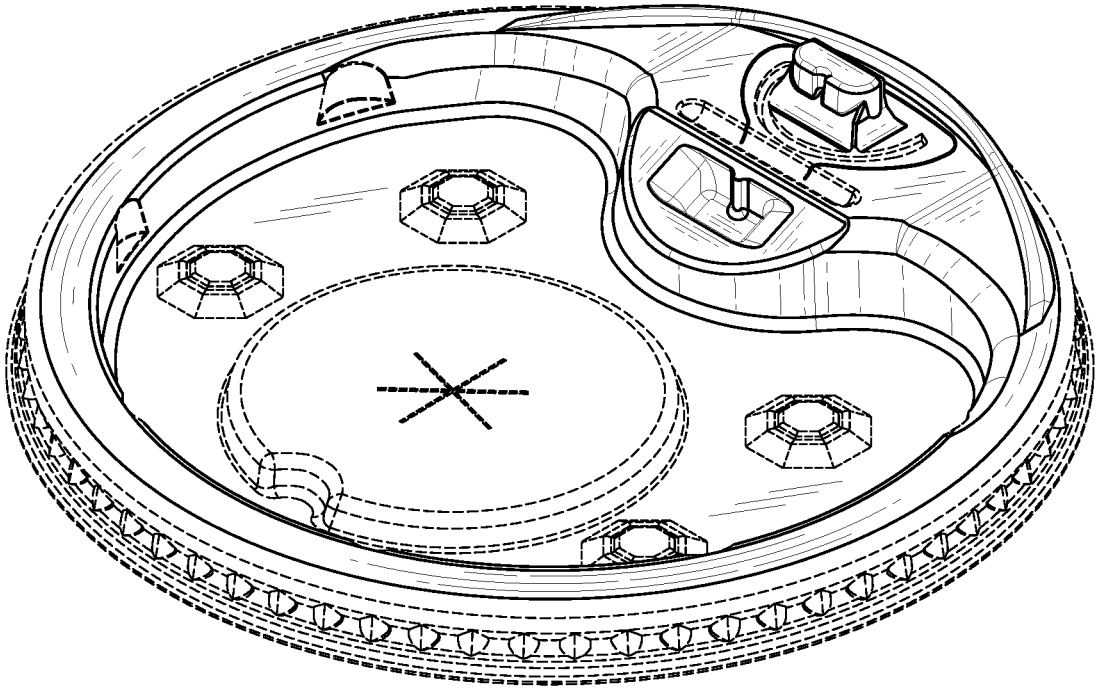
FIG. 45 is a perspective view of a tenth embodiment of a lid in accordance with the present disclosure.
Figure 46:
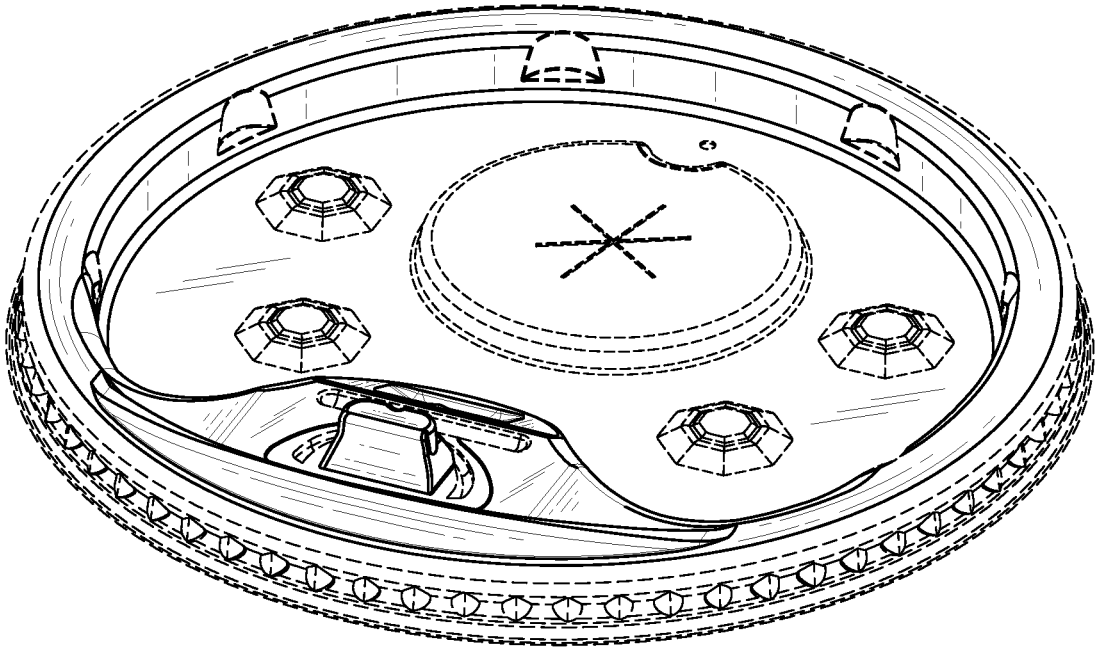
FIG. 46 is a top perspective view of the tenth embodiment of the lid.
Figure 47:
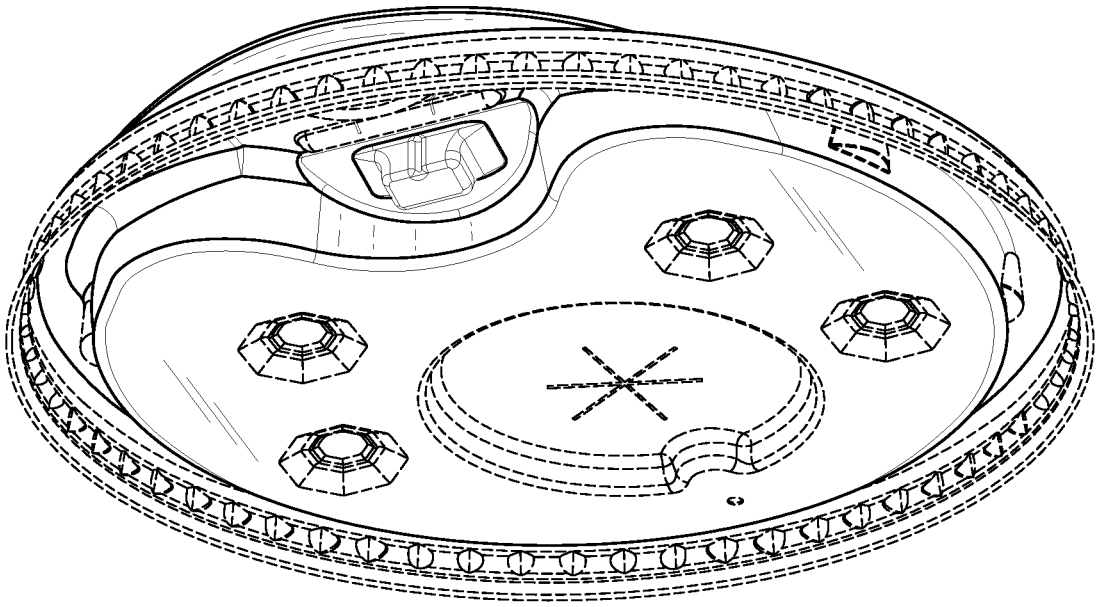
FIG. 47 is a bottom perspective view of the tenth embodiment of the lid
Figure 48:
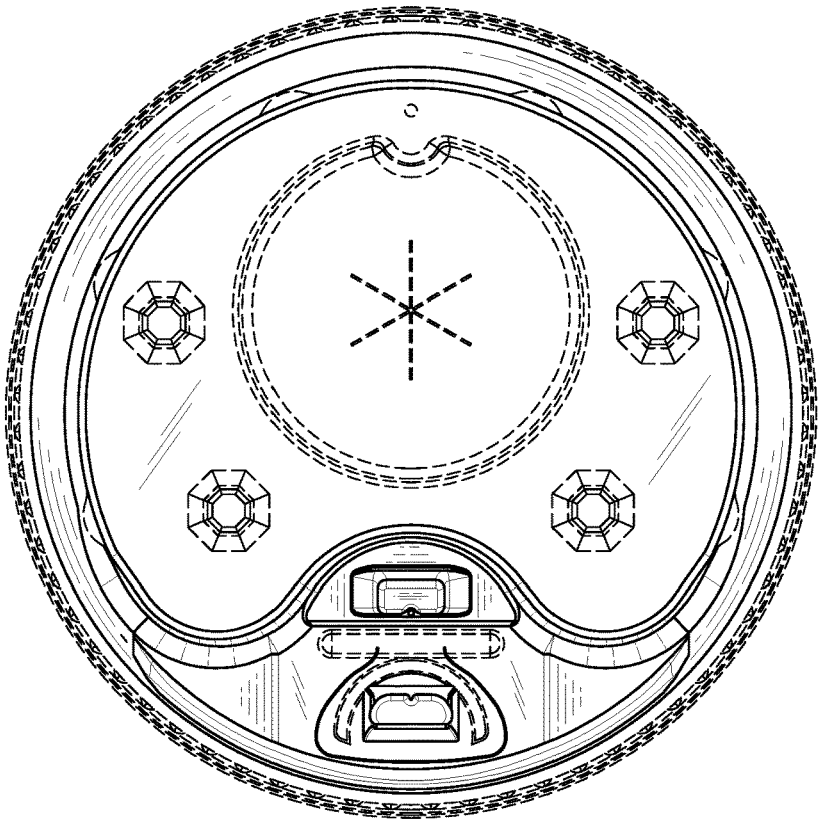
FIG. 48 is a top plan view of the tenth embodiment of the lid.
Figure 49:
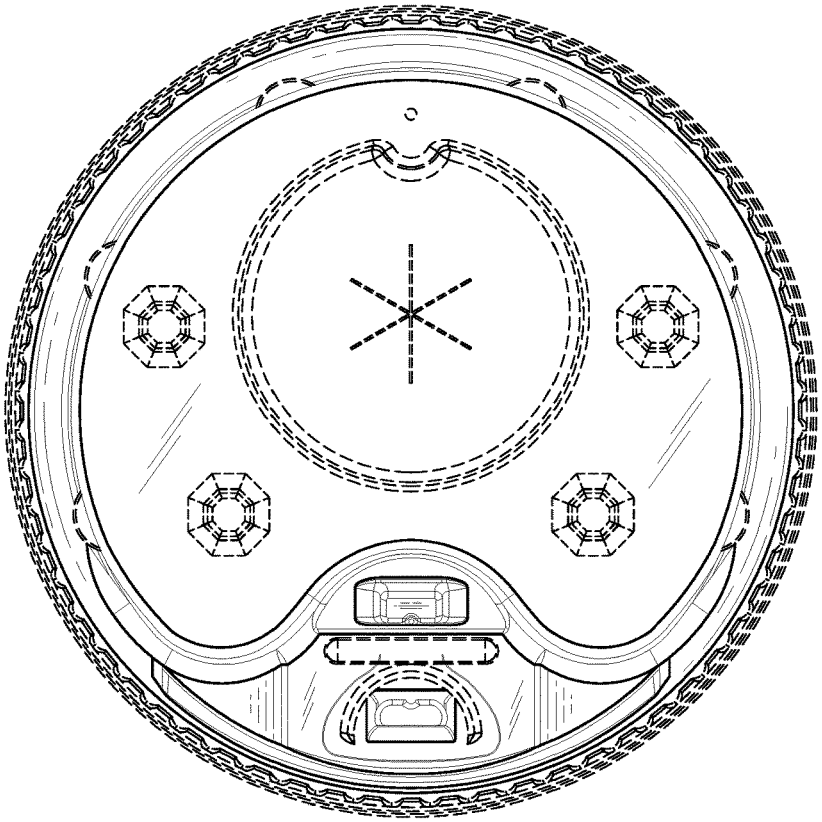
FIG. 49 is a bottom plan view of the tenth embodiment of the lid.
Figure 50:
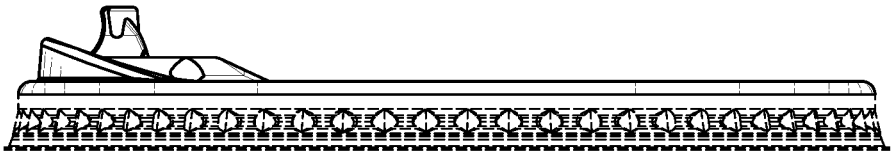
FIG. 50 is a side elevation view of the tenth embodiment of the lid.
Figure 51:
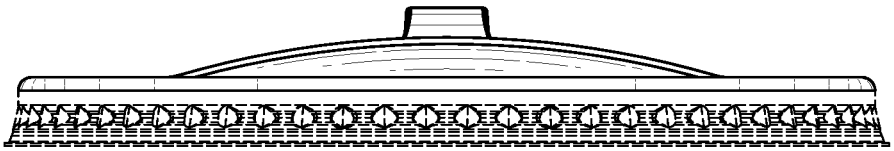
FIG. 51 is a rear elevation view of the tenth embodiment of the lid.
Figure 52:
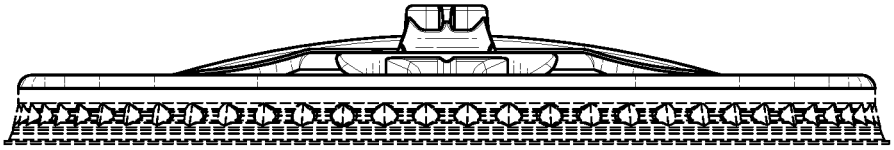
FIG. 52 is a front elevation view of the tenth embodiment of the lid.

A liquid container 10 in accordance with the present disclosure includes a cup 12 having a brim 14 and a lid 20 that is configured to mate with the brim 14 of the cup 12 using an interference fit to cover an interior liquid reservoir chamber 15 of the cup 12. A first illustrative embodiment of a container 10 including lid 20 is shown in FIGS. 1-8. A second illustrative embodiment of a lid 220 that can be used with cup 12 is shown in FIG. 9. A third illustrative embodiment of a lid 320 that can be used with cup 12 is shown in FIG. 10. A fourth illustrative embodiment of a lid 420 that can be used with cup 12 is shown in FIG. 11. A fifth illustrative embodiment of a lid 520 that can be used with cup 12 is shown in FIG. 12. Other views of lids in accordance with the present disclosure are shown in FIGS. 13-52.

Figure 1:
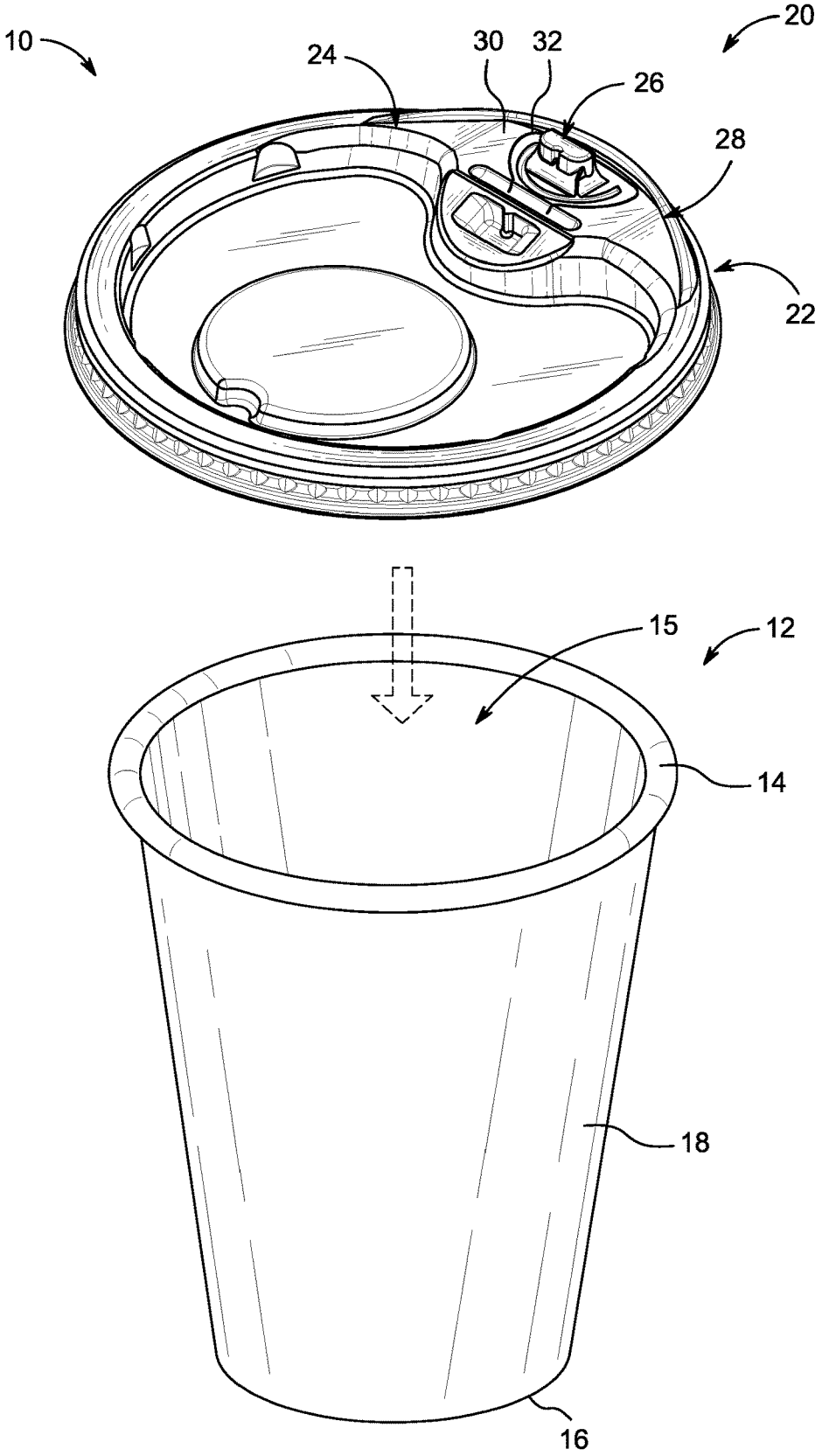
FIG. 1 is a perspective view of a lid in accordance with a first embodiment of the present disclosure and a cup before the lid is mounted on the cup and showing that the lid includes a central closure surrounded by a brim mount and an upstanding drink spout that is formed to include a liquid-discharge outlet and includes an outlet closure movable about a horizontal pivot axis between a closed position blocking access to the liquid-discharge outlet, as shown in FIG. 2, and an opened position where the outlet closure is spaced apart from the liquid-discharge outlet and retained in the opened position by an outlet closure retainer formed in the upstanding drink spout, as show in FIGS. 5 and 8.

Cup 12 includes a brim 14, a floor 16, and a side wall 18 extending upwardly from floor 16 to brim 14 as shown in FIG. 1. Side wall 18 and floor 16 cooperate to form interior liquid reservoir chamber 15 of cup 12. It is within the scope of this disclosure to make cup 12 out of any suitable plastics, paper, combinations thereof, and other material(s). It is within the scope of this disclosure to mount floor 16 in a suitable location at or near a lower edge of side wall 18.

Figure 2:
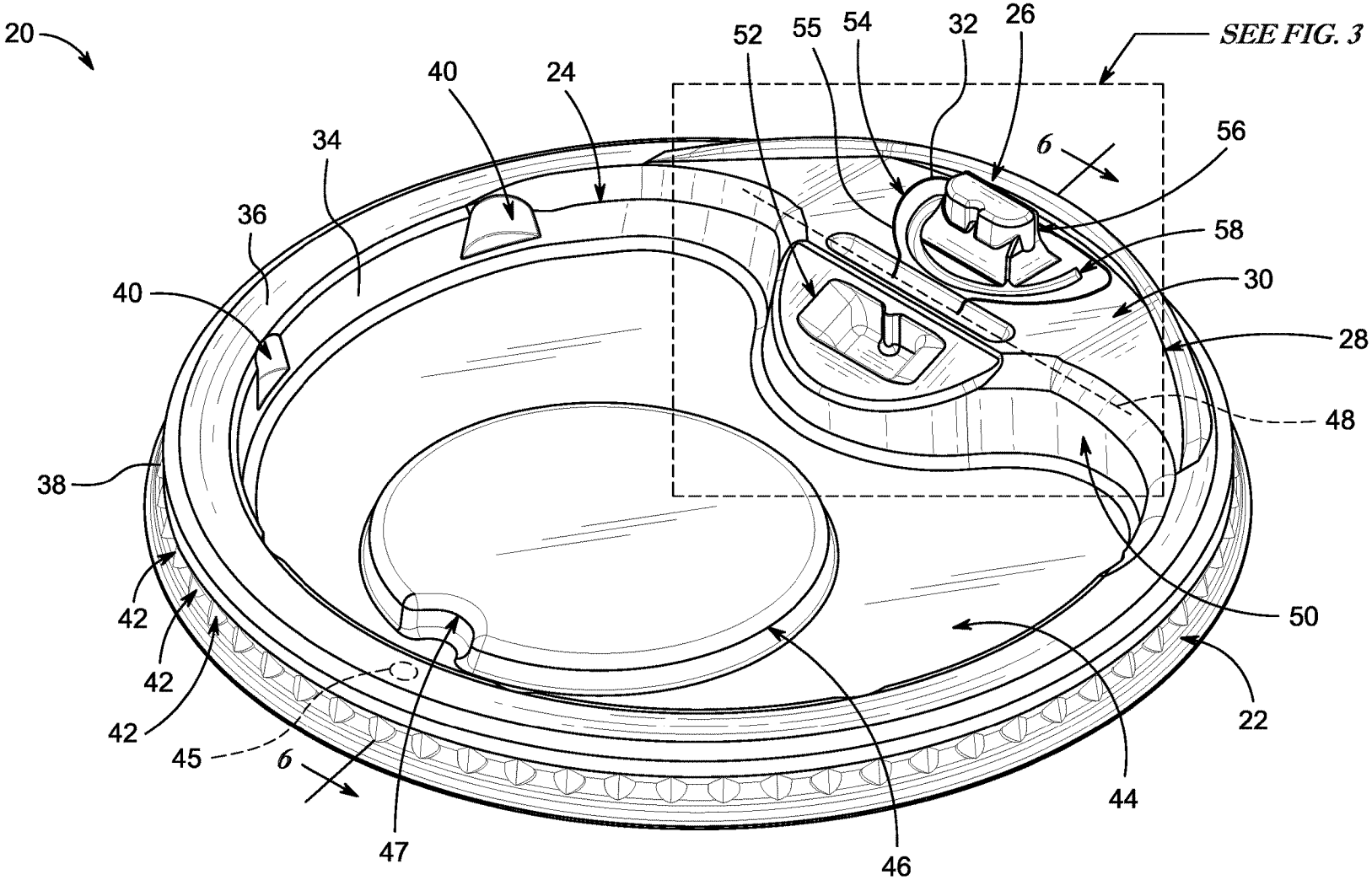
FIG. 2 is an enlarged perspective view of the lid with the outlet closure in the closed position.
Figure 3:
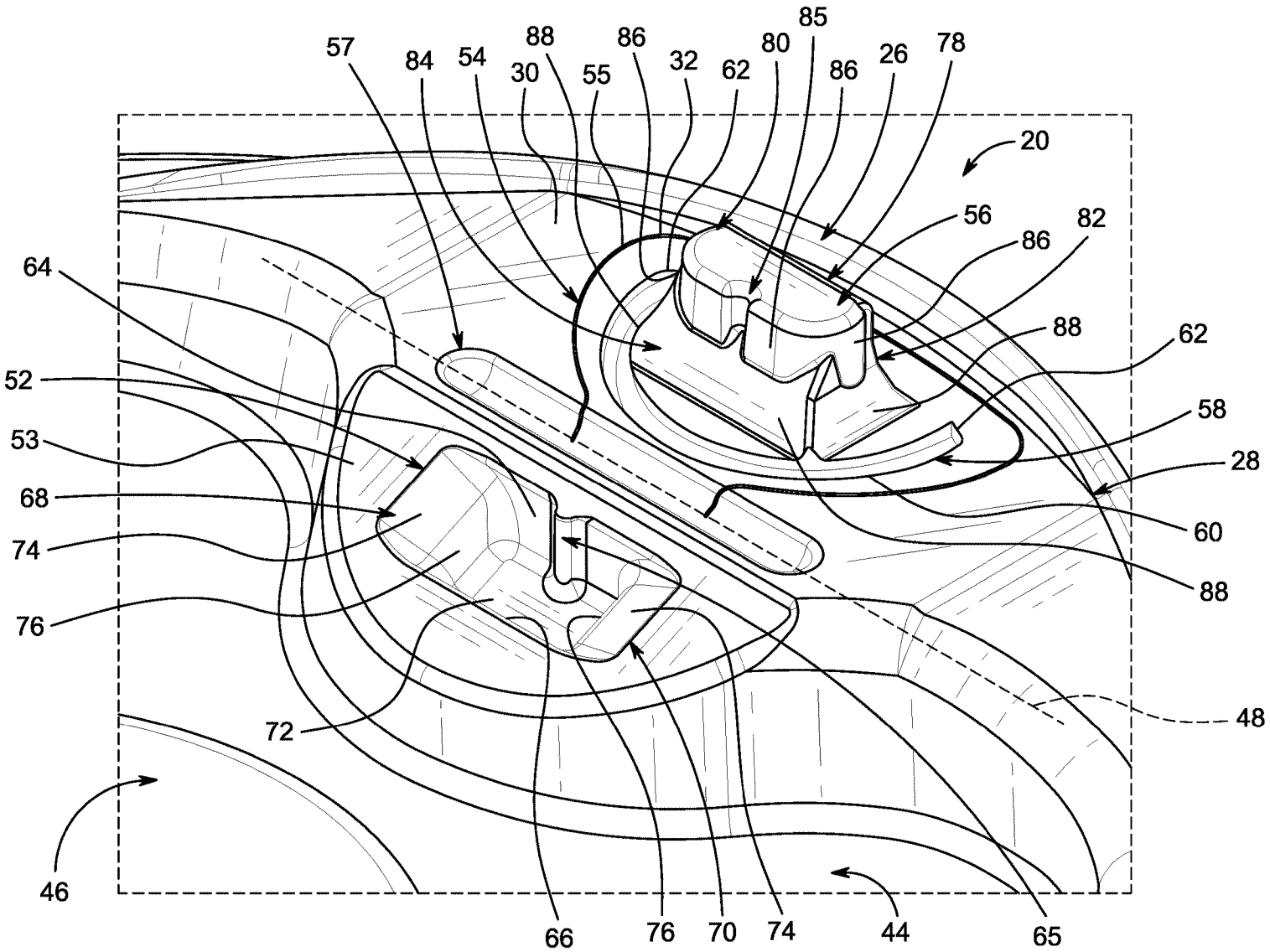
FIG. 3 is an enlarged portion of FIG. 2 showing the outlet closure and the outlet closure retainer in detail, the outlet closure including an outlet-closure skirt that matches a shape of the liquid-discharge outlet and an outlet-closure pedestal that extends upwardly away from the outlet-closure skirt and has a shape that corresponds with the outlet-closure retainer.
Figure 4:
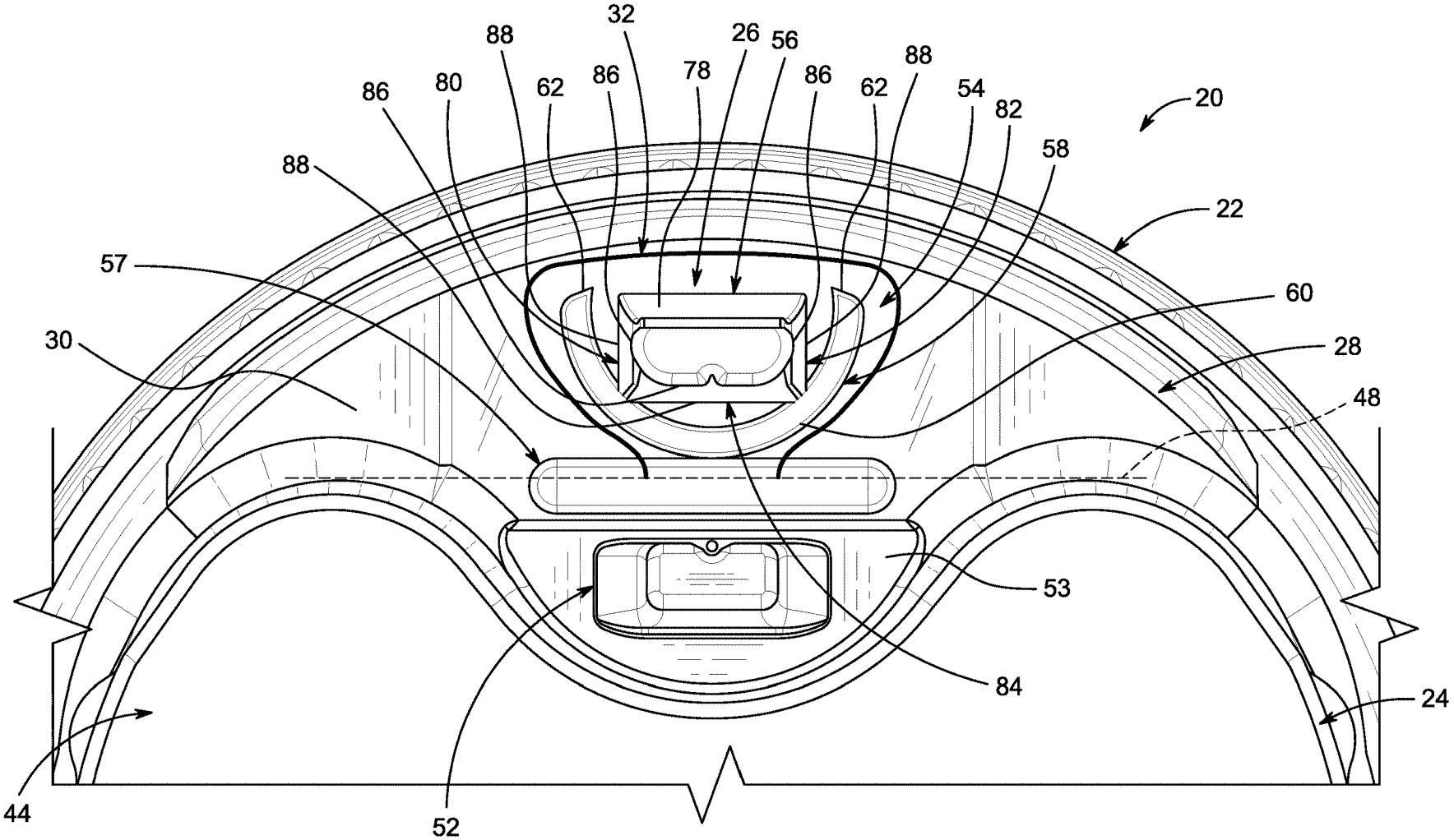
FIG. 4 is a top plan view of a portion of the lid showing that the outlet closure further includes an arcuate reinforcement rib that extends partway around the outlet-closure pedestal to increase a rigidity of the outlet closure so that the outlet closure pivots about the horizontal pivot axis when moving from the closed position to the opened position to ensure that the outlet-closure pedestal is aligned with the outlet-closure retainer when the outlet closure reaches the opened position.

Lid 20 may include any size suitable to coincide with brim 14 of cup 12 as suggested in FIG. 1 and includes a ring-shaped brim mount 22, a central closure 24, and an outlet closure 26 as shown in FIGS. 1-3. Brim mount 22 cooperates with brim 14 to provide a sealing interface to block flow of liquids between brim 14 and lid 20 when lid 20 is mounted on cup 12. Central closure 24 of lid 20 rises upwardly above brim mount 22 in illustrative embodiments and includes an upstanding drink spout 28 including a top wall 30 formed to include a liquid-discharge outlet 32 as suggested in FIGS. 1-3. Outlet closure 26 is sized and arranged to cover liquid-discharge outlet 32 until a consumer desires to remove liquid from the interior liquid reservoir chamber 15. In an illustrative embodiment, a consumer can drink liquid stored in cup 12 while lid 20 remains mounted on brim 14 of cup 12 through the liquid-discharge outlet 32 formed in lid 20. Drink spout 28 is adapted to be received in the mouth of a consumer desiring to drink a liquid stored in cup 12. Any liquid stored in interior liquid reservoir chamber 15 of cup 12 is in fluid communication with the liquid-discharge outlet 32 formed in top wall 30 of the upstanding drink spout 28 as suggested in FIG. 1.

Figure 7:
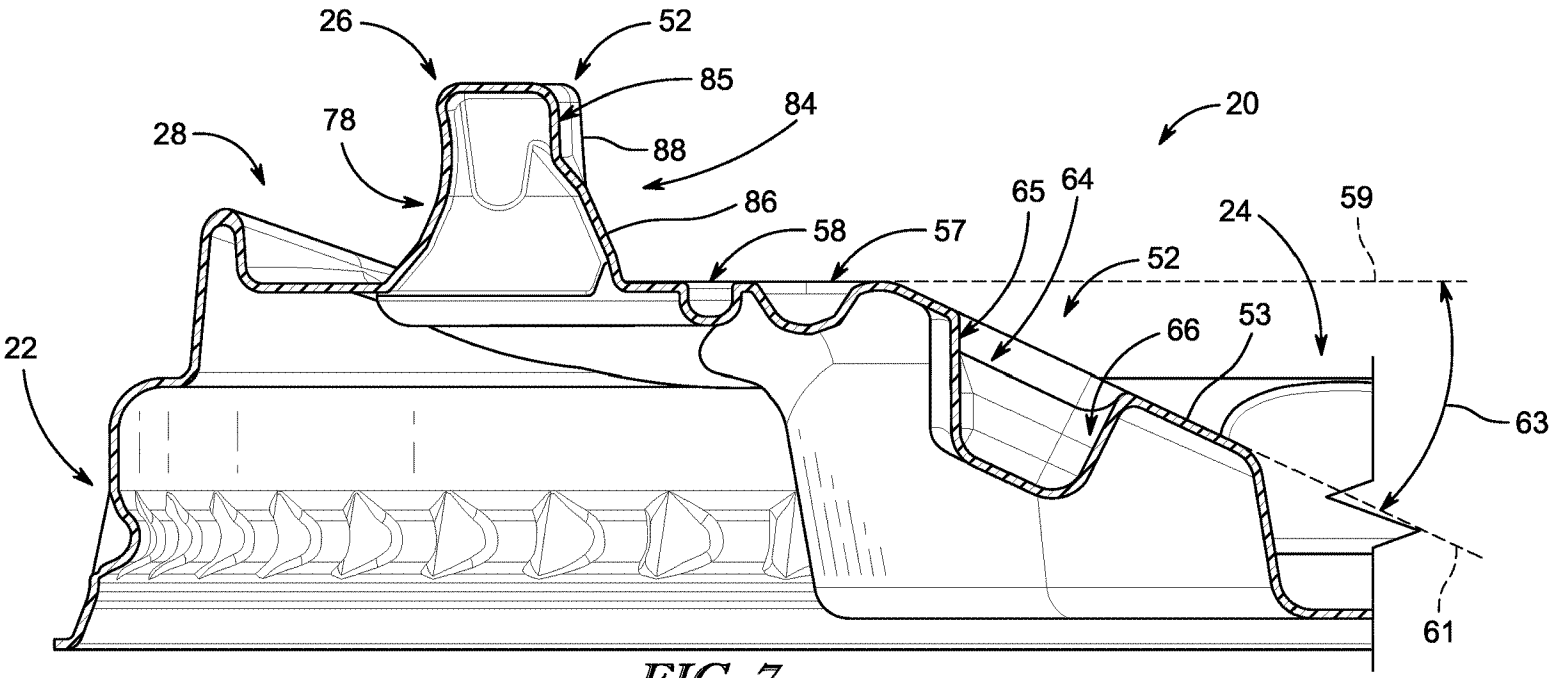
FIG. 7 is an enlarged portion of FIG. 6 showing the shape of the upstanding drink spout in detail.

Ring-shaped brim mount 22 includes an inner side wall 34, a top wall 36, and an outer side wall 38 as shown in FIG. 2. Inner side wall 34, top wall 36, and outer side wall 38 define an upside down U-shape when brim mount 22 is viewed in cross section as shown in FIG. 7. Inner side wall 34 is coupled to central closure 24. Top wall 36 provides an uppermost surface of the brim mount 22. Outer side wall 38 is spaced apart radially from inner side wall 34. Inner side wall 34, top wall 36, and outer side wall 38 are configured to engage different parts of brim 14 to establish multiple sealing interfaces with brim 14. Inner side wall 34 is formed to include a series of indents 40 while outer side wall 38 is formed to include a series of ribs 42. Indents 40 and ribs 42 may provide a more secure grip on brim 14 than a lid without indents 40 and/or ribs 42 and may facilitate stacking of multiple lids 20 for storage. Without indents 40 and/or ribs 42 there may be more engagement on the brim 14. The ribs 42 may provide relief from the interference and give rigidity to the brim mount 22 of the lid 20 when applying or removing the lid 20 from the brim 14 of the cup 12.

Central closure 24 is coupled to inner side wall 34 of brim mount 22 and forms an upper barrier to block liquids from flowing out of interior liquid reservoir chamber 15 until outlet closure 26 is removed from liquid-discharge outlet 32. Central closure includes drink spout 28, a central basin 44, and a plateau 46 as shown in FIG. 2. Drink spout 28 is coupled to central basin 44 and extends upwardly to a raised elevation above top wall 36 of brim mount 22. Drink spout 28 is the only structure of lid 20 that raises above top wall 36 to provide lid 20 with a low profile to minimize an overall weight of lid 20 as will be described in greater detail herein. Central basin 44 is coupled to inner side wall 34 of brim mount 22 and is arranged below top wall 36. Plateau 46 extends upwardly from central basin 44 and is also arranged to lie below top wall 36 of brim mount 22.

Figure 5:
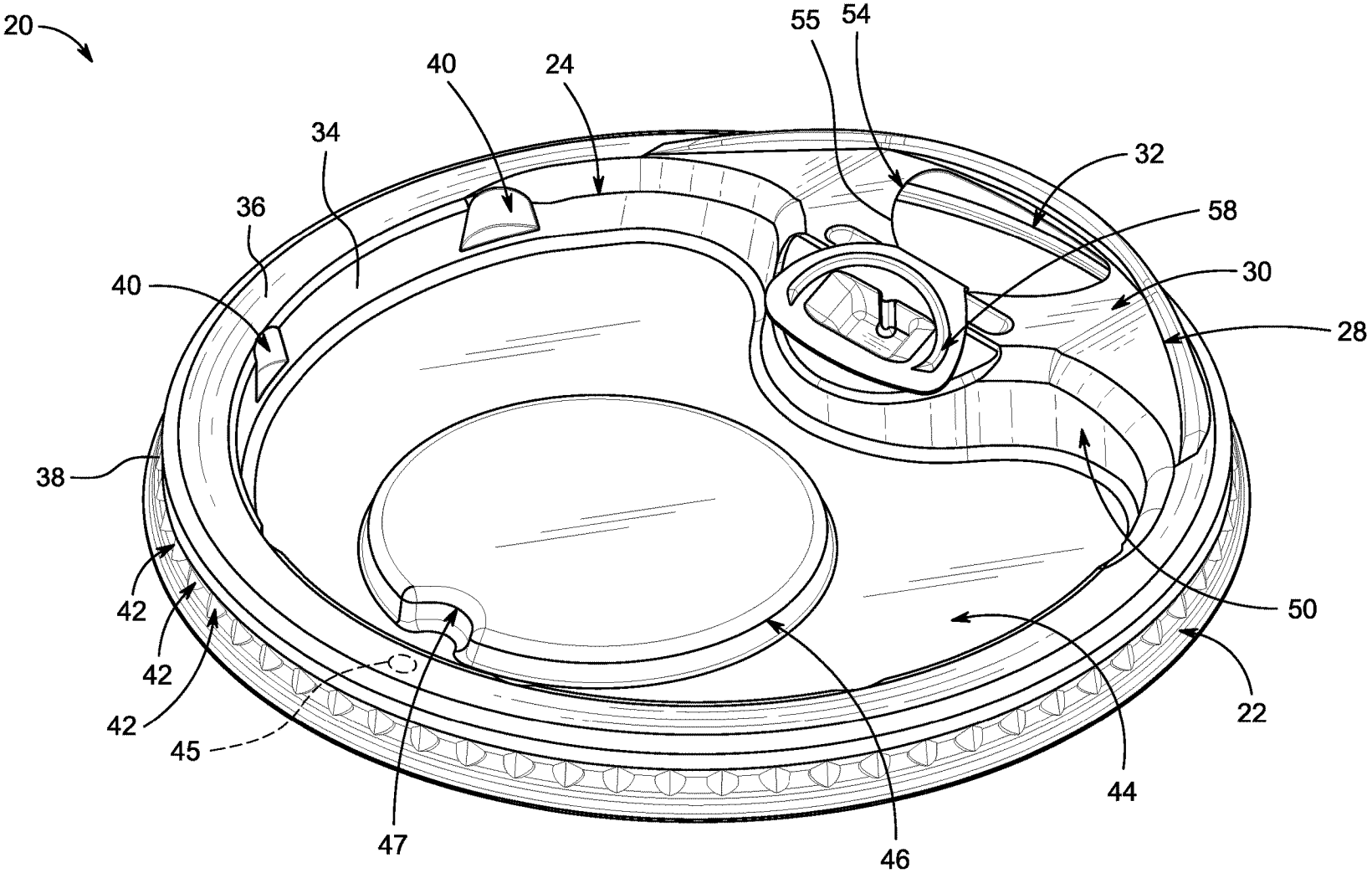
FIG. 5 is an enlarged perspective view of the lid with the outlet closure in the opened position.
Figure 8:
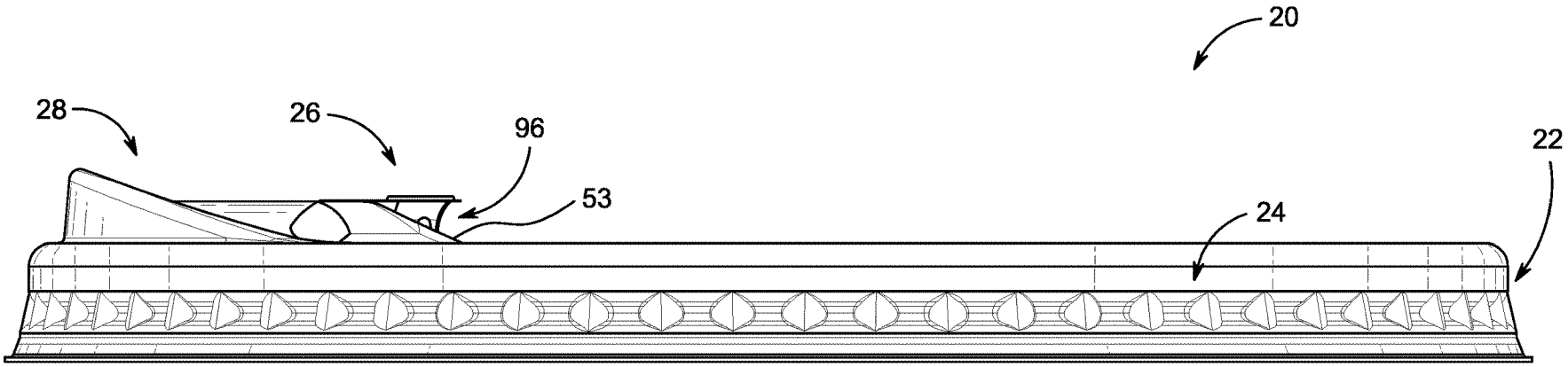
FIG. 8 is a side elevation view of the lid with the outlet closure in the opened position showing the outlet-closure skirt spaced apart from the outlet-closure retainer so that a user fit their finger between the outlet-closure skirt and the outlet-closure retainer to disengage the outlet closure from the outlet-closure retainer and return the outlet closure to the closed position.

Outlet closure 26 is movable about a horizontal pivot axis 48 between a closed position blocking access to the liquid-discharge outlet 32, as shown in FIGS. 1-3, and an opened position spaced apart from liquid-discharge outlet 32 as shown in FIGS. 5 and 8. Drink Spout 28 further includes a side wall 50 and an outlet-closure retainer 52 configured to retain outlet closure 26 in the opened position. Side wall 50 extends downwardly from top wall 30 and is coupled to central basin 44. Outlet-closure retainer 52 is illustratively embodied as a cavity that is formed into a reclined surface 53 of side wall 50. Outlet-closure retainer 52 has a shape that receives at least a portion of outlet closure 26 in the opened position to retain the outlet closure 26 in the opened position with an interface fit.

Outlet closure 26 includes an outlet-closure skirt 54, an outlet-closure pedestal 56 that extends upwardly from outlet-closure skirt 54, and an outlet-closure reinforcement rib 58 coupled to the outlet-closure skirt 54 as shown in FIGS. 2 and 3. The outlet-closure skirt 54 has an outer edge with a shape that matches a perimeter of the liquid-discharge outlet 32. The outer edge of outlet-closure skirt 54 and the perimeter of liquid-discharge outlet 32 may be initially coupled to one another to provide a break line 55. Break line 55 may be provided by a series of perforations, scoring, or another suitable method in top wall 30 which allows outlet-closure skirt 54 to be at least partially separated from top wall 30 along break line 55. Outlet-closure pedestal 56 is formed in a generally central region of outlet-closure skirt 54 and is configured to be engaged by a consumer to change outlet closure 26 from the closed position to the opened position for access to liquids in interior liquid reservoir chamber 15. Outlet-closure reinforcement rib 58 increases a rigidity of outlet closure 26 so that outlet closure 26 pivots relative to top wall 30 about horizontal pivot axis 48 to facilitate changing outlet closure 26 from the closed position to the opened position.

Outlet-closure reinforcement rib 58 is formed as an indentation into an outer surface of outlet-closure skirt 54 and has an arcuate shape to extend at least partially around outlet-closure pedestal 56 as shown in FIG. 3. Outlet-closure reinforcement rib 58 has a rounded outer edge 60 that faces toward horizontal pivot axis 48 and a pair of ends 62 that are spaced further away from horizontal pivot axis 48 than rounded outer edge 60. Break line 55 terminates in a groove 57 formed in top wall 30 to establish horizontal pivot axis 48 in groove 57. Groove 57 is spaced apart from outlet-closure reinforcement rib 58 to locate outlet-closure reinforcement rib 58 between outlet-closure pedestal 56 and groove 57. Outlet-closure reinforcement rib 58 directs forces toward horizontal pivot axis 48 and blocks outlet closure 26 from folding along a line somewhere between outlet-closure pedestal 56 and horizontal pivot axis 48 so that outlet closure 26 is aligned with outlet-closure retainer 52 when outlet closure 26 reaches the opened position.

Outlet-closure retainer 52 has a shape that corresponds to at least a portion of outlet-closure pedestal 56 as shown in FIG. 5. Outlet-closure retainer 52 is defined by a forward surface 64, a rear surface 66, first and second lateral surfaces 68, 70 and a bottom surface 72. Forward surface 64 has a retainer protrusion 65 formed equidistant apart from each lateral surface 68, 70. The first and second lateral surfaces 68, 70 provide guide surfaces for outlet-closure pedestal 56 to facilitate a consumer in inserting outlet-closure pedestal into outlet-closure retainer 52. The first and second lateral surfaces each include an angled upper portion 74 that extend toward one another and a vertically extending lower portion 76 arranged parallel to one another. Outlet-closure retainer 52 has a width between each angled upper portion 74 that is greater than a corresponding portion of outlet-closure pedestal 56. The width of outlet-closure retainer 52 may be slightly less than the corresponding portion of outlet-closure pedestal at lower portions 76 to provide the interface fit between outlet-closure retainer 52 and outlet-closure pedestal 56.

Outlet-closure pedestal 56 includes a curved surface 78 that faces outwardly away from a center of lid 20, a first side surface 80, an opposite second side surface 82, and a retainer surface 84 that faces toward the center of lid 20 as shown in FIG. 3. Curved surface 78 provides an ergonomic finger pad for a consumer to use to lift and change outlet closure 26 from the closed position to the opened position. First side surface 80, second side surface 82, and retainer surface 84 each include a vertically extending portion 86 spaced apart from outlet-closure skirt 54 and a broadening portion 88 that extends downward and outward away from each companion vertically extending portion 86 and is coupled to outlet-closure skirt 54. Each broadening portion 88 contacts outlet-closure reinforcement rib 58 to form a portion of outlet-closure reinforcement rib 58. Retainer surface 84 is also formed to include an indentation 85 that receives retainer protrusion 65 when outlet-closure pedestal 56 is inserted in outlet-closure retainer 52 in the closed position.

Figure 6:
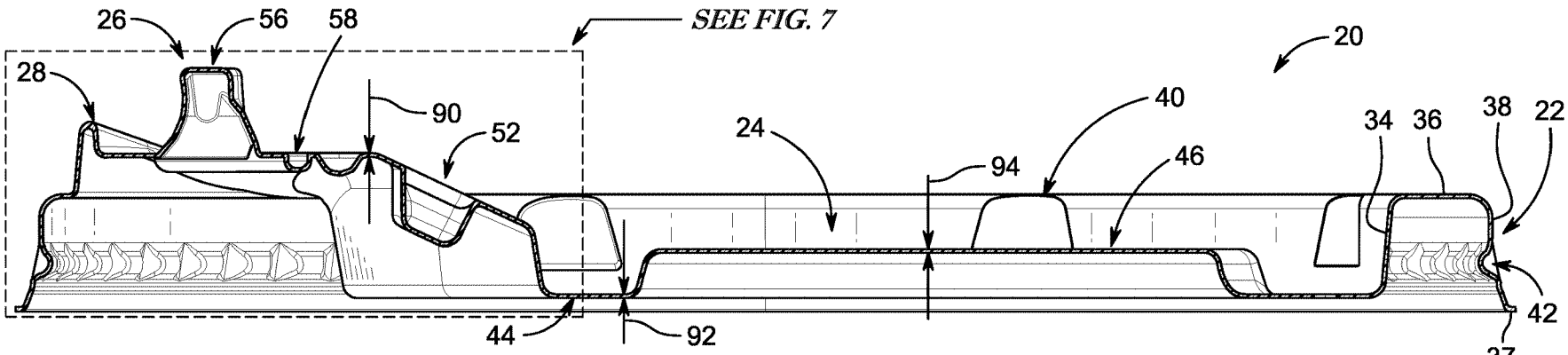
FIG. 6 is a sectional view of the lid taken along line 6-6 in FIG. 2 to show that the lid is made from a sheet with a thickness that varies between several different locations of the lid.

Lid 20 is made from a sheet of polymeric material that includes polypropylene. In some embodiments, the sheet consists of polypropylene, however, the sheet may include other polymeric materials such as, for example, polystyrene, polyethylene, or any other suitable polymeric material. The sheet is formed into lid 20 using a thermoforming process in illustrative embodiments, however, any other suitable forming process may also be used. Lid 20 is shaped to have a low profile such that substantially all of the features of lid 20 are arranged between top wall 36 of brim mount 22 and a lower edge 37 of brim mount as shown in FIGS. 6 and 7. Only drink spout 28 extends above top wall 36 so as to minimize the amount of material required to form lid 20.

A thickness of the sheet may be minimized to reduce the overall weight of lid 20 as shown in FIG. 6. Minimizing the thickness of the sheet may cause areas of lid 20 to be flexible, however, flexibility in certain areas such as outlet closure 26, for example, may not be desired. Accordingly, outlet-closure reinforcement rib 58 is provided on outlet closure 26 to rigidify outlet closure 26 to facilitate movement of outlet closure 26 about horizontal pivot axis 48 between the closed and opened positions.

The sheet forming lid 20 may have a first thickness 90 at drink spout 28, a second thickness 92 at central basin 44, and a third thickness 94 at plateau 46. In some embodiments, second thickness 92 is less than both first thickness 90 and third thickness 94. In some embodiments, the third thickness 94 is less than or equal to the first thickness 90 and greater than the second thickness 92.

The following Examples of lids 20 are non-limiting. All of the values shown below for Examples 1 to 3 are approximate and may have a manufacturing tolerance within plus or minus 20 percent.

Example 1

The first example of a lid 20 with varying thicknesses 90, 92, 94 is described below in Table 1. This lid 20 is made from polypropylene and has an outer diameter of about 4.25 inches.

TABLE 1

| Gram Weight | Thickness 90 | Thickness 92 | Thickness 94 | Weight/ Diameter Ratio |
|---|---|---|---|---|
| 2.96 g | 0.015 in | 0.012 in | 0.014 in | 0.7 |

Example 2

The second example of a lid 20 with varying thicknesses 90, 92, 94 is described below in Table 2. This lid 20 is made from polypropylene and has an outer diameter of about 3.97 inches.

TABLE 2

| Gram Weight | Thickness 90 | Thickness 92 | Thickness 94 | Weight/ Diameter Ratio |
|---|---|---|---|---|
| 2.77 g | 0.014 in | 0.011 in | 0.014 in | 0.7 |

Example 3

The third example of a lid 20 with varying thicknesses 90, 92, 94 is described below in Table 3. This lid 20 is made from polypropylene and has an outer diameter of about 3.64 inches.

TABLE 3

| Gram Weight | Thickness 90 | Thickness 92 | Thickness 94 | Weight/ Diameter Ratio |
|---|---|---|---|---|
| 2.04 g | 0.013 in | 0.010 in | 0.013 in | 0.56 |

Accordingly, lid 20 may have a weight-to-diameter ratio of less than 1 due to the low profile design of lid 20, the thicknesses 90, 92, 94, and the material used to form lid 20. In some embodiments, the weight-to-diameter ratio is within a range of about 0.5 to about 0.8. In some embodiments, the weight-to-diameter ratio is within a range of about 0.55 to about 0.8. In some embodiments, the weight-to-diameter ratio is within a range of about 0.6 to about 0.8. In some embodiments, the weight-to-diameter ratio is within a range of about 0.65 to about 0.8. In some embodiments, the weight-to-diameter ratio is within a range of about 0.7 to about 0.8. In some embodiments, the weight-to-diameter ratio is within a range of about 0.75 to about 0.8. In some embodiments, the weight-to-diameter ratio is within a range of about 0.5 to about 0.75. In some embodiments, the weight-to-diameter ratio is within a range of about 0.5 to about 0.7. In some embodiments, the weight-to-diameter ratio is within a range of about 0.5 to about 0.65. In some embodiments, the weight-to-diameter ratio is within a range of about 0.5 to about 0.6. In some embodiments, the weight-to-diameter ratio is within a range of about 0.5 to about 0.55. In some embodiments, the weight-to-diameter ratio is within a range of about 0.55 to about 0.75. In some embodiments, the weight-to-diameter ratio is within a range of about 0.68 to about 0.7. In some embodiments, the weight-to-diameter ratio is within a range of about 0.69 to about 0.8. In some embodiments, the weight-to-diameter ratio is within a range of about 0.57 to about 0.6.

Example 4

The fourth example of a comparable lid that is different than lid 20 of the illustrative embodiment is described below in Table 4. This lid is made from polyethylene terephthalate and has an outer diameter of about 3.97 inches. The lid also has varying thicknesses 90, 92, however, the lid does not have a plateau 46 so thickness 94 is not applicable.

TABLE 4

| Gram Weight | Thickness 90 | Thickness 92 | Thickness 94 | Weight/ Diameter Ratio |
|---|---|---|---|---|
| 3.82 g | 0.015 in | 0.011 in | N/A | 0.96 |

Referring back to lid 20 of the illustrative embodiment, top wall 30 of drink spout 28 is arranged to lie on a horizontal plane 59 as shown in FIG. 7. Reclined surface 53 is arranged to lie on a retainer plane 61 which extends away from top wall 30 at an angle 63 relative to horizontal plane 59. In one embodiment, angle 63 is within a range of about 5 degrees to about 80 degrees. In one embodiment, angle 63 is within a range of about 10 degrees to about 80 degrees. In one embodiment, angle 63 is within a range of about 15 degrees to about 80 degrees. In one embodiment, angle 63 is within a range of about 20 degrees to about 80 degrees. In one embodiment, angle 63 is within a range of about 25 degrees to about 80 degrees. In one embodiment, angle 63 is within a range of about 30 degrees to about 80 degrees. In one embodiment, angle 63 is within a range of about 35 degrees to about 80 degrees. In one embodiment, angle 63 is within a range of about 40 degrees to about 80 degrees. In one embodiment, angle 63 is within a range of about 45 degrees to about 80 degrees. In one embodiment, angle 63 is within a range of about 50 degrees to about 80 degrees. In one embodiment, angle 63 is within a range of about 55 degrees to about 80 degrees. In one embodiment, angle 63 is within a range of about 60 degrees to about 80 degrees. In one embodiment, angle 63 is within a range of about 65 degrees to about 80 degrees. In one embodiment, angle 63 is within a range of about 70 degrees to about 80 degrees. In one embodiment, angle 63 is within a range of about 75 degrees to about 80 degrees. In one embodiment, angle 63 is within a range of about 5 degrees to about 75 degrees. In one embodiment, angle 63 is within a range of about 5 degrees to about 70 degrees. In one embodiment, angle 63 is within a range of about 5 degrees to about 65 degrees. In one embodiment, angle 63 is within a range of about 5 degrees to about 60 degrees. In one embodiment, angle 63 is within a range of about 5 degrees to about 55 degrees. In one embodiment, angle 63 is within a range of about 5 degrees to about 50 degrees. In one embodiment, angle 63 is within a range of about 5 degrees to about 45 degrees. In one embodiment, angle 63 is within a range of about 5 degrees to about 40 degrees. In one embodiment, angle 63 is within a range of about 5 degrees to about 35 degrees. In one embodiment, angle 63 is within a range of about 5 degrees to about 30 degrees. In one embodiment, angle 63 is within a range of about 5 degrees to about 25 degrees. In one embodiment, angle 63 is within a range of about 5 degrees to about 20 degrees. In one embodiment, angle 63 is within a range of about 5 degrees to about 15 degrees. In one embodiment, angle 63 is within a range of about 5 degrees to about 10 degrees. In another example, angle 63 is within a range of about 10 degrees to about 60 degrees. In another example, angle 63 is within a range of about 20 degrees to about 50 degrees. In another example, angle 63 is within a range of about 20 degrees to about 30 degrees, In another example, angle 63 is about 25 degrees.

Forward surface 64 is arranged to extend substantially in a vertical direction perpendicular to horizontal plane 59 as shown in FIG. 7. Rear surface 66 is arranged to lie at an angle to forward surface 64 to provide clearance for outlet-closure pedestal 56 to extend into outlet-closure retainer 52 as outlet closure 26 rotated about horizontal pivot axis 48 from the closed position to the opened position. In the opened position, outlet-closure skirt 54 remains substantially parallel to horizontal plane 59 to provide a gap 96 between outlet-closure skirt 54 and reclined surface 53 so that the consumer can fit a finger there between to remove outlet-closure pedestal from outlet-closure retainer and return outlet closure to the closed position as shown in FIG. 8.

Lid 20 may include plateau 46 for any of a variety of reasons. Plateau 46 may include, for example, a company logo or indicia and/or a slotted straw opening. Plateau 46 may include an orientation indentation 47 at or near a rear portion of plateau 46 for any of a variety of reasons, including but not limited to helping a user locate the rear part of lid 20, for example by locating and/or feeling orientation indentation 47 with a finger without actually looking at lid 20. Orientation indentation 47 may be formed in a side wall of orientation indentation 47, which may extend upwardly from central basin 44. By locating orientation indentation 47, a user may be better able to locate liquid-discharge outlet 32 and/or outlet closure 26, for example, and better prevent spilling when attempting to drink through lid 20. Lid 20 may also be formed to include a vent aperture 45 in central basin 44, which may for example be located at or near plateau 46 and/or orientation indentation 47 as show in FIG. 2. Vent aperture 45 may be included for any of a variety of reasons, or not at all.

Another embodiment of a lid 220 in accordance with the present disclosure is shown in FIG. 9. Lid 220 is substantially similar to lid 20. Accordingly, reference numbers in the 200 series are used to reference common features between lid 220 and lid 20. The disclosure of lid 20 is hereby incorporated by reference for lid 220 while the differences between lid 220 and lid 20 are described below.

Lid 220 includes a ring-shaped brim mount 222, a central closure 224, and an outlet closure 226 as shown in FIG. 9. Brim mount 222 cooperates with brim 14 to provide a sealing interface to block flow of liquids between brim 14 and lid 220 when lid 220 is mounted on cup 12. Central closure 224 of lid 220 rises upwardly above brim mount 222 in illustrative embodiments and includes an upstanding drink spout 228 including a top wall 230 formed to include a liquid-discharge outlet 232. Outlet closure 226 is sized and arranged to cover liquid-discharge outlet 232 until a consumer desires to remove liquid from the interior liquid reservoir chamber 15.

Ring-shaped brim mount 222 includes an inner side wall 234, a top wall 236, and an outer side wall 238 as shown in FIG. 9. Central closure 224 is coupled to inner side wall 234 of brim mount 222 and forms an upper barrier to block liquids from flowing out of interior liquid reservoir chamber 15 until outlet closure 226 is removed from liquid-discharge outlet 232. Central closure 224 includes drink spout 228, a central basin 244, and a plateau 246 as shown in FIG. 9. Drink spout 228 is coupled to central basin 244 and extends upwardly to a raised elevation above top wall 236 of brim mount 222. Drink spout 228 is the only structure of lid 220 that raises above top wall 236 to provide lid 220 with a low profile to minimize an overall weight of lid 220 as will be described in greater detail herein. Central basin 244 is coupled to inner side wall 234 of brim mount 222 and is arranged below top wall 236. Plateau 246 extends upwardly from central basin 244 and is also arranged to lie below top wall 236 of brim mount 222. A straw opening 297 is formed in a top wall of plateau 246. Central basin 244 is formed to include a vent aperture 245. Accordingly, lid 220 may be used for drinking a liquid from cup 12 by through liquid-discharge outlet 232 or with a straw (not shown) inserted in straw opening 297.

Another embodiment of a lid 320 in accordance with the present disclosure is shown in FIG. 10. Lid 320 is substantially similar to lid 20. Accordingly, reference numbers in the 300 series are used to reference common features between lid 320 and lid 20. The disclosure of lid 20 is hereby incorporated by reference for lid 320 while the differences between lid 320 and lid 20 are described below.

Lid 320 includes a ring-shaped brim mount 322, a central closure 324, and an outlet closure 326 as shown in FIG. 10. Brim mount 322 cooperates with brim 14 to provide a sealing interface to block flow of liquids between brim 14 and lid 320 when lid 320 is mounted on cup 12. Central closure 324 of lid 320 rises upwardly above brim mount 322 in illustrative embodiments and includes an upstanding drink spout 328 including a top wall 330 formed to include a liquid-discharge outlet 332. Outlet closure 326 is sized and arranged to cover liquid-discharge outlet 332 until a consumer desires to remove liquid from the interior liquid reservoir chamber 15.

Ring-shaped brim mount 322 includes an inner side wall 334, a top wall 336, and an outer side wall 338 as shown in FIG. 10. Central closure 324 is coupled to inner side wall 334 of brim mount 322 and forms an upper barrier to block liquids from flowing out of interior liquid reservoir chamber 15 until outlet closure 326 is removed from liquid-discharge outlet 332. Central closure 324 includes drink spout 328, a central basin 344, and a plateau 346 as shown in FIG. 10. Drink spout 328 is coupled to central basin 344 and extends upwardly to a raised elevation above top wall 336 of brim mount 322. Drink spout 328 is the only structure of lid 320 that raises above top wall 336 to provide lid 320 with a low profile to minimize an overall weight of lid 320 as will be described in greater detail herein. Central basin 344 is coupled to inner side wall 334 of brim mount 322 and is arranged below top wall 336. Plateau 346 extends upwardly from central basin 344 and is also arranged to lie below top wall 336 of brim mount 322.

Central basin 344 includes a plurality of push buttons 398 that extend upwardly in the same direction as plateau 346. The plurality of push buttons 398 provide a mechanism for a user to provide an input to at least one of the buttons so that the button will change from a first condition to a second condition. For example, a user may push a button 398 so that it is no longer upwardly projecting but rather changes to a downwardly projecting state that a user can readily visually or tactilely identify. Such a feature could be used to indicate the contents of a cup to which the lid is coupled. Central basin 344 may also include other indicia near each button 398 that could be used also to provide information to a user in any of a variety of ways. Indicia and push buttons 398 could cooperate to communicate information to a user, such as a button 398 proximate a certain indicia being used to suggest that indicia.

Another embodiment of a lid 420 in accordance with the present disclosure is shown in FIG. 11. Lid 420 is substantially similar to lid 20. Accordingly, reference numbers in the 400 series are used to reference common features between lid 420 and lid 20. The disclosure of lid 20 is hereby incorporated by reference for lid 420 while the differences between lid 420 and lid 20 are described below.

Lid 420 includes a ring-shaped brim mount 422, a central closure 424, and an outlet closure 426 as shown in FIG. 11. Brim mount 422 cooperates with brim 14 to provide a sealing interface to block flow of liquids between brim 14 and lid 420 when lid 420 is mounted on cup 12. Central closure 424 of lid 420 rises upwardly above brim mount 422 in illustrative embodiments and includes an upstanding drink spout 428 including a top wall 430 formed to include a liquid-discharge outlet 432. Outlet closure 426 is sized and arranged to cover liquid-discharge outlet 432 until a consumer desires to remove liquid from the interior liquid reservoir chamber 15.

Ring-shaped brim mount 422 includes an inner side wall 434, a top wall 436, and an outer side wall 438 as shown in FIG. 11. Central closure 424 is coupled to inner side wall 434 of brim mount 422 and forms an upper barrier to block liquids from flowing out of interior liquid reservoir chamber 15 until outlet closure 426 is removed from liquid-discharge outlet 432. Central closure 424 includes drink spout 428, a central basin 444, and a plateau 446 as shown in FIG. 11. Drink spout 428 is coupled to central basin 444 and extends upwardly to a raised elevation above top wall 436 of brim mount 422. Drink spout 428 is the only structure of lid 420 that raises above top wall 436 to provide lid 420 with a low profile to minimize an overall weight of lid 420 as will be described in greater detail herein. Central basin 444 is coupled to inner side wall 434 of brim mount 422 and is arranged below top wall 436. Plateau 446 extends upwardly from central basin 444 and is also arranged to lie below top wall 436 of brim mount 422. A straw opening 497 is formed in a top wall of plateau 446. Central basin 444 is formed to include a vent aperture 445. Accordingly, lid 420 may be used for drinking a liquid from cup 12 through liquid-discharge outlet 432 or with a straw (not shown) inserted in straw opening 497.

Central basin 444 also includes a plurality of push buttons 498 that extend upwardly in the same direction as plateau 446. The plurality of push buttons 498 provide a mechanism for a user to provide an input to at least one of the buttons so that the button will change from a first condition to a second condition. For example, a user may push a button 498 so that it is no longer upwardly projecting but rather changes to a downwardly projecting state that a user can readily visually or tactilely identify. Such a feature could be used to indicate the contents of a cup to which the lid is coupled. Central basin 446 may also include other indicia near each button 498 that could be used also to provide information to a user in any of a variety of ways. Indicia and push buttons 498 could cooperate to communicate information to a user, such as a button 498 proximate a certain indicia being used to suggest that indicia.

Another embodiment of a lid 520 in accordance with the present disclosure is shown in FIG. 12. Lid 520 is substantially similar to lids 20 and 420. Accordingly, reference numbers in the 500 series are used to reference common features between lid 520 and lids 20 and 420. The disclosure of lids 20 and 420 is hereby incorporated by reference for lid 520 while the differences between lid 520 and lids 20, 420 are described below.

Lid 520 includes a ring-shaped brim mount 522, a central closure 524, and an outlet closure 526 as shown in FIG. 12. Brim mount 522 cooperates with brim 14 to provide a sealing interface to block flow of liquids between brim 14 and lid 520 when lid 520 is mounted on cup 12. Central closure 524 of lid 520 rises upwardly above brim mount 522 in illustrative embodiments and includes an upstanding drink spout 528 including a top wall 530 formed to include a liquid-discharge outlet 532. Outlet closure 526 is sized and arranged to cover liquid-discharge outlet 532 until a consumer desires to remove liquid from the interior liquid reservoir chamber 15.

Ring-shaped brim mount 522 includes an inner side wall 534, a top wall 536, and an outer side wall 538 as shown in FIG. 11. Central closure 524 is coupled to inner side wall 534 of brim mount 522 and forms an upper barrier to block liquids from flowing out of interior liquid reservoir chamber 15 until outlet closure 526 is removed from liquid-discharge outlet 532. Central closure 524 includes drink spout 528, a central basin 544, and a plateau 546 as shown in FIG. 12. Drink spout 528 is coupled to central basin 544 and extends upwardly to a raised elevation above top wall 536 of brim mount 522. Drink spout 528 is the only structure of lid 520 that raises above top wall 536 to provide lid 520 with a low profile to minimize an overall weight of lid 520 as will be described in greater detail herein. Central basin 544 is coupled to inner side wall 534 of brim mount 522 and is arranged below top wall 536. Plateau 546 extends upwardly from central basin 544 and is also arranged to lie below top wall 536 of brim mount 522. A straw opening 597 is formed in a top wall of plateau 546. Central basin 544 is formed to include a vent aperture 545. Accordingly, lid 520 may be used for drinking a liquid from cup 12 through liquid-discharge outlet 532 or with a straw (not shown) inserted in straw opening 597.

Central basin 544 also includes a plurality of push buttons 598 that extend upwardly in the same direction as plateau 546. The plurality of push buttons 598 provide a mechanism for a user to provide an input to at least one of the buttons so that the button will change from a first condition to a second condition. For example, a user may push a button 598 so that it is no longer upwardly projecting but rather changes to a downwardly projecting state that a user can readily visually or tactilely identify. Such a feature could be used to indicate the contents of a cup to which the lid is coupled. Central basin 544 may also include other indicia near each button 598 that could be used also to provide information to a user in any of a variety of ways. Indicia and push buttons 598 could cooperate to communicate information to a user, such as a button 598 proximate a certain indicia being used to suggest that indicia.

Outlet closure 526 includes an outlet-closure skirt 554 and an outlet closure pedestal 556 that extends upwardly from outlet-closure skirt 554. The outlet-closure skirt 554 has an outer edge with a shape that matches a perimeter of the liquid-discharge outlet 532. Outlet closure pedestal 556 is formed in a generally central region of outlet-closure skirt 554 and is configured to be engaged by a consumer to change outlet closure 526 from the closed position to the opened position for access to liquids in interior liquid reservoir chamber 15. Outlet closure pedestal 556 includes a pedestal tip 587 and a pedestal base 589. The transition from the pedestal base 589 to the pedestal tip 587 is more abrupt than the transition from broadening portions 88 to vertically extending portions 86 of outlet-closure pedestal 56.

In some embodiments, lid 20, and/or any component thereof, may be made of any of a variety of materials, including, but not limited to, any of a variety of suitable plastics material, any other material, or any combination thereof. Suitable plastics material may include, but is not limited to, polypropylene (PP), polyethylene (PE), polyethylene terephthalate (PET), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

In some embodiments, lid 20, and/or any component thereof, may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of lid 20, and/or any component thereof.

In some embodiments, a variety of processes or combination thereof may be used to form lid 20, and/or any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, lid 20, and/or any component thereof may be formed substantially of injection molded and/or thermoformed suitable plastics material, although other materials and forming processes may be used instead of or in addition to injection molding and thermoforming, respectively. Various materials and/or processes may be used to form lid 20, and/or any component thereof, as will be understood by one of ordinary skill in the art. In some embodiments, lid 20, and/or any component thereof, may be substantially a one-piece design and/or substantially formed as an integral or unitary structure. Reference is hereby made to U.S. Publication No. 2020/0140160 and titled DRINK CUP LID for disclosure relating to drink cup lids that are made from a material comprising polypropylene, which application is hereby incorporated in its entirety herein. Reference is hereby made to U.S. Publication No. 2019/0039328 and titled METHOD AND APPARATUS FOR THERMOFORMING AN ARTICLE for disclosure relating to a method of manufacturing lids, which application is hereby incorporated in its entirety herein.

In some embodiments, while some directional terms are used herein, such as top, bottom, upper, lower, inward, outward, upward, downward, etc., these terms are not intended to be limiting but rather to relate to one or more exemplary orientations, positions, and/or configuration of lid 20, and/or any component thereof. It is understood lid 20 and/or any component or portion thereof may be inverted or re-oriented to face or point a different direction without departing from the nature of lid 20 disclosed herein.

The invention claimed is:

1. A drink cup lid comprising a ring-shaped brim mount adapted to mate with a brim of a drink cup, a central closure surrounded by the brim mount and formed to include an upstanding drink spout having a top wall formed to include a liquid-discharge outlet and a side wall arranged to extend downwardly from the top wall toward an interior region surrounded by the ring-shaped brim mount, and an outlet closure coupled to the top wall of the upstanding drink spout for movement about a horizontally extending pivot axis between a closed position closing the liquid-discharge outlet formed in the top wall of the upstanding drink spout and an opened position away from the liquid-discharge outlet, wherein the drink cup lid is made from a sheet comprising polypropylene and the drink cup lid has a weight-to-diameter ratio of less than 1 and weight is measured in grams and diameter is measured in inches, and wherein the outlet closure includes an outlet-closure skirt having an outer edge that matches a perimeter edge of the liquid-discharge outlet, an outlet-closure pedestal arranged to extend upwardly from the outlet-closure skirt, and a reinforcement rib coupled to the outlet-closure skirt.

2. The drink cup lid of claim 1, wherein a portion of the reinforcement rib is arranged to lie between the horizontally extending pivot axis and the outlet-closure pedestal.

3. The drink cup lid of claim 2, wherein the reinforcement rib projects downwardly in an opposite direction away from the outlet-closure pedestal.

4. The drink cup lid of claim 2, wherein the reinforcement rib has an arcuate shape that extends partway around the outlet-closure pedestal.

5. The drink cup lid of claim 1, wherein the drink spout includes an outlet-closure retainer sized to receive the outlet-closure pedestal in the opened position for retaining the outlet closure in a stationary position relative to the top wall upon movement of the outlet closure from the closed position to the opened position.

6. The drink cup lid of claim 5, wherein the outlet-closure pedestal includes a curved surface that faces outwardly away from a center of the lid, a first side surface, an opposite second side surface, and a retainer surface that faces toward the center.

7. The drink cup lid of claim 6, wherein the retainer surface is formed to include an indentation and the outlet-closure retainer includes a retainer protrusion that extends into the indentation when the outlet-closure pedestal is inserted in the outlet-closure cavity in the closed position.

8. The drink cup lid of claim 6, wherein the first side surface, the second side surface, and the retainer surface each include a vertically extending portion and a broadening portion that extends downward and outward away from each companion vertically extending portion.

9. The drink cup lid of claim 8, wherein each broadening portion contacts the reinforcement rib.

10. The drink cup lid of claim 8, wherein the outlet-closure retainer further includes a first lateral guide surface that has a shape that matches the first side surface of the outlet-closure pedestal and an opposite second lateral guide surface that has a shape that matches the second side surface of the outlet-closure pedestal.

11. The drink cup lid of claim 10, wherein the first lateral guide surface and the second lateral guide surface each have an angled upper portion that extend toward one another and a vertically extending lower portion arranged parallel to one another.

12. The drink cup lid of claim 11, wherein the outlet-closure retainer is a cavity having an inlet opening that is formed into a reclined surface of the upstanding drink spout, the reclined surface being angled to extend downwardly away from the liquid-discharge outlet.

13. A drink cup lid comprising a ring-shaped brim mount adapted to mate with a brim of a drink cup, a central closure surrounded by the brim mount and formed to include an upstanding drink spout having a top wall formed to include a liquid-discharge outlet and a side wall arranged to extend downwardly from the top wall toward an interior region surrounded by the ring-shaped brim mount, and an outlet closure coupled to the top wall of the upstanding drink spout for movement about a horizontally extending pivot axis between a closed position closing the liquid-discharge outlet formed in the top wall of the upstanding drink spout and an opened position away from the liquid-discharge outlet, wherein the drink cup lid is made from a sheet comprising polypropylene and the drink cup lid has a weight-to-diameter ratio of less than 1 and weight is measured in grams and diameter is measured in inches, and wherein the ring-shaped brim has an uppermost surface and only the upstanding drink spout and the outlet closure are arranged above the uppermost surface relative to the rest of the drink cup lid.

14. A drink cup lid comprising a ring-shaped brim mount adapted to mate with a brim of a drink cup, a central closure surrounded by the brim mount and formed to include an upstanding drink spout having a top wall formed to include a liquid-discharge outlet and a side wall arranged to extend downwardly from the top wall toward an interior region surrounded by the ring-shaped brim mount, and an outlet closure coupled to the top wall of the upstanding drink spout for movement about a horizontally extending pivot axis between a closed position closing the liquid-discharge outlet formed in the top wall of the upstanding drink spout and an opened position away from the liquid-discharge outlet, wherein the drink cup lid is made from a sheet comprising polypropylene and the drink cup lid has a weight-to-diameter ratio of less than 1 and weight is measured in grams and diameter is measured in inches, and wherein the central closure further includes a closure basin and the sheet has a first thickness at the upstanding drink and the sheet has a second thickness different than the first thickness at the closure basin.

15. The drink cup lid of claim 14, wherein the closure basin includes a lower top wall having the second thickness and a plateau coupled to the lower top wall and spaced apart from the upstanding drink spout and the brim mount.

16. The drink cup lid of claim 15, wherein the plateau is formed to include an orientation indentation that provides a touch-indication of the orientation of the lid to indicate to a user where the liquid-discharge outlet is without viewing the lid.

17. The drink cup lid of claim 15, wherein the plateau has a third thickness that is greater than the second thickness and less than or equal to the first thickness.

18. The drink cup lid of claim 16, wherein the weight-to-diameter ratio is within a range of about 0.5 to about 0.8.

19. The drink cup lid of claim 18, wherein the weight-to-diameter ratio is within a range of about 0.55 to about 0.75.

* * * * *